US005444457A

United States Patent [19]

Hotto

[11] Patent Number: 5,444,457

[45] Date of Patent: Aug. 22, 1995

[54] DC INTEGRATING DISPLAY DRIVER EMPLOYING PIXEL STATUS MEMORIES

[75] Inventor: Robert Hotto, 3109 Evening Way, La Jolla, Calif. 92037

[73] Assignee: Robert Hotto, La Jolla, Calif.

[21] Appl. No.: 88,256

[22] Filed: Jul. 7, 1993

Related U.S. Application Data

[63] Continuation of Ser. No. 705,190, May 24, 1991, Pat. No. 5,280,280.

[51] Int. Cl.[6] ..... G09G 3/36

[52] U.S. Cl. ..... 345/94; 345/148

[58] Field of Search ..... 345/89, 94, 96, 101, 345/100, 148

[56] References Cited

U.S. PATENT DOCUMENTS

| | | | |
|---|---|---|---|
| 4,737,782 | 4/1988 | Fukuma et al. . | |
| 5,010,326 | 4/1991 | Yamazaki et al. | 345/98 |
| 5,034,736 | 7/1991 | Bennett et al. | 345/100 |
| 5,280,280 | 1/1994 | Hotto | 345/148 |

OTHER PUBLICATIONS

"Selection Limits in Matrix Displays," Alan Sobel; Revised 1971, pp. 1-34 & Figures 1-6.

"Scanning Limitations of Liquid-Crystal Displays," Alt & Pleshko; Feb. 1974, pp. 146-155.

"Liquid Crystal Displays," L. A. Goodman; Sep./Oct. 1973, Cover sheet & pp. 816-823.

"Switching Properties of Twisted Nematic Liquid Crystal Displays," Cess J. Gerritsma; May 1974, pp. 164-165.

"Experimental Comparison of Multiplexing Techniques for Liquid Crystal Displays," A. R. Kmetz; 1972, pp. 66-67.

"Ultimate Limits for Matrix Addressing of RMS-Responding Liquid-Crystal Displays," Nehring & Kmetz; May 1970, pp. 795-802.

"Liquid Crystal Displays," Allan R. Kmetz; 12/81, pp. 3-8.

"Combined Alphanumeric and Dot Matrix Display As Base For A New Measuring Concept," Dr. Martin W. Haussel; pp. 1-5.

"6.1: A Twisted Nematic Dual Bargraph System," Allan R. Kmetz; 1977, pp. 58-59.

"Characterization and Optimization of Twisted Nematic Displays for Multiplexing," Alan R. Kmetz; 1978, pp. 70-71.

"Interconnection and Addressing Methods for LCD Arrays with Fewer Leads Than a Matrix," A. R. Kmetz; Jul. 1983, pp. 131-134.

"Matrix Addressing of Non-Emissive Displays," A. R. Kmetz; (Undated), pp. 261-289.

"Liquid-Crystal Display Prospects in Perspective," Allan R. Kmetz; Nov. 1973, pp. 954-961.

"Ultimate Limits For RMS Matrix Addressing," A. R. Kmetz & J. Nehring; (Undated), pp. 105-113.

"Addressing Methods for Non-Multiplexed Liquid Crystal Oscilloscope Displays," Ian A. Shanks & Paul A. Holland; 1979, pp. 112-113.

(List continued on next page.)

*Primary Examiner*—Jeffery Brier

*Attorney, Agent, or Firm*—Ellsworth R. Roston; Charles H. Schwartz

[57] ABSTRACT

This invention relates to an improved drive and control means for matrix addressable electro-optic displays, such as passive matrix LCDs and active matrix LCDs. The present invention achieves improved drive and control of displays through the use of real time computation and memory circuits to simulate the electro-optic condition and the accumulated DC bias of individual display elements. This eliminates the burden of frequent and symmetrical reversals of the drive polarity, and allows the implementation of flexible DC drive methodologies.

65 Claims, 8 Drawing Sheets

OTHER PUBLICATIONS

"General Theory of Matrix Addressing Liquid Crystal Displays," Clark, Shanks, & Patterson, 1979, pp. 110–111.

"New Addressing Techniques For Multiplexed Liquid Crystal Displays," Ruckmongathan & Madhusudana; 1983, pp. 259–262.

"Reduction of Brightness Non-Uniformity in RMS Responding Matrix Displays," Ruckmongathan, Verheggen, Welzen, (Undated), pp. 290–294.

"A Generalized Addressing Technique For RMS Responding Matrix LCDs," Ruckmongathan, 1988, Cover sheet (1990) & pp. 80–85.

"An LCD For Multitrace Oscilloscopes," Ruckmongathan, 1986, p. 128.

"A New Addressing Technique For Fast Responding STN LCDs," Ruckmonganthan, Kuwata, et al, 1992, pp. 65–68.

"Addressing Techniques For RMS Responding LCDs—A Review," Ruckmongathan, 1992, pp. 77–80.

EXAMPLE OF DRIVE VOLTAGES FOR PIXEL WITH SELECTIVE FREQUENCY.

EXAMPLE OF DRIVE VOLTAGES FOR PIXEL WITH SELECTIVE DWELL.

EXAMPLE OF DRIVE VOLTAGES FOR PIXEL WITH SELECTIVE VOLTAGE, DWELL AND FREQUENCY.

DC INTEGRATING DISPLAY DRIVER EMPLOYING PIXEL STATUS MEMORIES

This is a continuation of application Ser. No. 07/705,190 (now U.S. Pat. No. 5,280,280), filed May 24, 1991, now U.S. Pat. No. 5,280,280.

BACKGROUND OF THE INVENTION

It is well known that matrix displays such as liquid crystal displays, both passive matrix and active matrix varieties, are composed of two planes (usually clear glass or plastic) having a multitude of conductive electrodes which sandwich a film of electro-optic material, such as liquid crystal material. Each point of intersection of the conductive electrodes between the front and back planes forms the site of a picture element (pixel). In the active matrix display varieties, a thin film of non-linear or active devices such as diodes, transistors, or varistors are also included at the intersections of the electrodes.

It is understood that liquid crystal displays (LCDs) are activated by an AC wave form in order to minimize destructive effects to the display element which are caused by accumulating DC bias. These destructive effects consist of electrolytic plating and chemical breakdown of the electrodes and of electrochemical breakdown of the crystal material.

Thus, prior art liquid crystal display elements in the "on" state are alternately subjected to equal and opposite polarities of electrical bias on a continuous basis at a fixed frequency (AC drive) to avoid the destructive properties of an accumulated DC bias. Several compromises are made to drive LCDs with this existing scheme. Higher AC drive frequencies allow the display to respond more quickly to an update, but have lower display contrasts, narrower viewing angles and use power less efficiently. Lower AC drive frequencies are more efficient and have greater contrast, but update more slowly since the AC drive frame cycle must always be completed before an update is made in order to achieve a neutral bias.

The present invention avoids these compromises by means of an improved driving scheme which eliminates the burden of requiring frequent and symmetric reversals of drive polarity. This enables the implementation of improved DC drive techniques while still neutralizing the DC bias on the pixels before destructive effects occur. The present invention allows the display controller to respond more quickly to display update requests by eliminating the need to complete the current frame cycle and the opposing polarity cycle before responding to the next display update request. When the display controller must change the gray level of one or more pixels, this request is acted upon immediately, with the existing DC bias of the display element stored in memory so that the display element's bias can be compensated for at a later time. This technique is called "bias reconciliation". The net DC bias on the display element at the time of update is called "DC bias violation". With the present invention, when the display controller receives a request to update the display, the controller does not need to delay until the current display frame cycle is completed, as is required by prior art display drive systems. Rather, the circuit reacts instantly to the update, and the DC bias violation status of the display element is updated in memory.

"Real Time Display Simulation" refers to the use of memory and computation means to simulate the condition of the display in real time. Aspects of the display which are simulated in the present invention include the existing electro-optical condition of the pixels, the accumulated DC bias on the pixels, and the difference between the existing condition of the display and the most recent demanded image. Use of real time display simulation techniques allows the implementation of the display drive and control techniques which will be explained herein. "DC bias violation" is a represented quantity referring to the integration of the varying voltage levels applied over time to each individual pixel. "Bias reconciliation" is the reduction and neutralization of the DC bias violation to insure the maintenance of safe DC bias violations. This is achieved by means of keeping track in memory of the accumulated electrical bias on the pixels and reversing the polarity of the drive signal before any pixel reaches a predetermined bias level. The bias status can, therefore, remain or accumulate in one polarity for multiple display periods. (For prior art, the polarity of the drive signal is reversed at a fixed frequency that is between every 400th to 30th of a second).

"Maximum bias violation tolerance" (MBVT) refers to a transfer function of time and DC bias. It is the measure of the net DC bias a pixel can sustain without suffering irreversible damage due to electrochemical reactions. (Note: With existing fixed cycle AC multiplex drive methods, the pixels experience non-zero DC bias within a fixed frame cycle, but this is,always brought to zero by the end of the frame cycle.) MBVT refers to the upper limit of the DC bias violation a pixel can sustain. Exceeding the MBVT for a display element will cause destructive effects to the display and will lower the life expectancy of the display. The parameters for MBVT will vary among different displays as a function of the materials used and the structure of the display. "Selective Real Time Drive Sequencing" is the display control technique in the present invention in which the display controller selectively varies in real time the electrode drive sequence, the duty cycle, and the backplane/segment plane drive functions. "Pixel Power Modulation" is a novel display control technique in the present invention in which the display controller selectively varies (or modulates) in real time the power applied to individual pixels to maintain them in the desired gray band. The employment of these techniques enables improved and more flexible means of driving and controlling passive and active matrix liquid crystal displays.

A passive matrix liquid crystal display can be viewed as a matrix of slightly leaky capacitors as illustrated in FIG. 2. Each matrix location is identified by a corresponding equivalent resistance—capacitance pair Rnm Cnm when n is the row location and m in the column location. There is minimal resistance (approximately 100 ?) in the connections between pixels, so when a charge is established across a pixel, it dissipates quickly through the matrix.

An active matrix liquid crystal display can be viewed as array of capacitors all having the backplane as a common plate with each X and Y column and row location having an individual active element in contact with the active plane, as illustrated in FIG. 3. FIG. 3 shows both front and side views of an active matrix led display. Therefore, the pixels require repetitive rewrites in order to maintain them at desired gray levels or to drive them to new gray levels. To accomplish this, prior art multiplex drives operate as follows: The drive signals are applied to two sets of electrodes typically arrayed in rows and columns. Voltage select signals are sequentially and periodically applied to each backplane electrode in a repetitive cycle. In synchronism with the backplane electrode select signal, the segment plane select signals are applied in parallel, thus affecting the electro-optic conditions of the pixels at the intersections of these selected backplane electrodes and the selected segment plane electrodes. An ON pixel has, therefore, experienced an applied RMS voltage that exceeds its threshold turn-on voltage, whereas an OFF pixel has experienced a voltage below threshold voltage.

The frame refresh rate must be kept above 30 Hz or the display will appear to flicker. As the number of display elements increases in the prior art, the multiplex ratio must be increased in order to address the greater number of elements. As the multiplex ratio is increased (more backplanes), less time is available to sequentially drive each backplane, and the driver must operate at a higher voltage and frequency to produce the required RMS drive signal.

As the drive voltage is increased and time duration decreased in response to these higher multiplex ratios, the discrimination ratio (the difference) between on and off RMS voltage decreases. This creates an appearance of semi-selected pixels, decreases display contrasts and introduces cross talk. In effect, since there is less time available to drive each pixel, there is less controllability, thereby decreasing the number of available gray levels.

Another major intrinsic drawback of the prior art fixed cycle AC matrix drive techniques is illustrated as follows:

At the point in the driving cycle at which the pixel is driven to the opposite polarity it passes through the zero voltage condition. This causes the opacity of the pixel to decrease (become less gray) until it reaches the full off condition for a brief moment. The pixel then becomes more gray as it is driven to the reverse polarity. The gray level perceived by the eye is thus less intense since the eye integrates all of the gray levels of the transition. This point in the drive cycle exhibits a decrease in display output in conjunction with an increase in energy consumption. This effect is counter to what is desired and represents a major difficulty. This decreased display output effect becomes progressively worse as the drive frequency is increased.

The purpose of a display drive controller is to cause an image to appear on the display which conforms as closely as possible to a demanded or desired image. In many displays (e.g. CRTs, LCDs, LEDs, etc.) the projected image is not static like a photograph. Such displays are referred to as monostable. In monostable displays, even when the desired (or demanded) image is unchanging, the gray level of each pixel is continually varying in intensity. Typically, the gray level of each pixel decays until it is refreshed or driven, which "recharges" the pixel to a higher gray level.

In LCD drive controls, the drive's refresh and decay mechanism is employed to achieve desired gray levels as follows. Each pixel is white in appearance at the low energy state (also called the ground state or off state). Each pixel appears black at the high energy state (also called the saturation state or on state). At energy levels between the low energy white state and the high energy black state, liquid crystal pixels will display a range of gray levels. .However, prior art LCD controllers do not take advantage of that range of gray levels as will be described hereinafter. (Note: By altering the orientation of the polarizing filters used in a liquid crystal display, the display's appearance can be reversed so that a pixel appears black in the low energy state and white in the high-energy state. For the sake of clarity, this discussion will proceed with the assumption that the pixels appear white in the low energy state. However, the present invention can be applied to displays with either orientation.)

To increase the gray level of a liquid crystal pixel, the drive controller applies an electric field across the pixel. The field distorts the molecular orientation of the liquid crystal material thereby changing its optical characteristics, appearing as an increased gray level.

A relationship exists between the voltage across a liquid crystal pixel and the gray level of the pixel. The curve which shows the relationship between applied voltage and gray level is called the "electro-optic turn on curve". Similarly the pixel exhibits an "electro-optic turn off curve" as the liquid crystal material relaxes and returns to its low energy state when the applied voltage is removed. It is noted in U.S. Pat. No. 4,921,334, Matrix Liquid Crystal Display With Extended Gray Scale, by Boris A. Akodes, that the distribution of these gray levels is not linear. Additionally, the "electro-optic turn on curve" is not symmetric to the "electro-optic turn off curve"—the hysteresis of the turn off curve is typically 2½to 4 slower than the turn on curve time characteristic. (FIG. 4 of this application illustrates the nonlinearity of the turn on curves.) The time required for liquid crystal material to undergo molecular twist from an off state to an on state is referred to as the "excursion time".

Typical full on excursion times for LCD displays with current materials range from 0.05 milliseconds for Ferro? material to 60 milliseconds for supertwisted nematic material at room temperature, depending on the particular liquid crystal material used. This is the time delay required for an element to change from a fully off state (white) to a fully on state (black) when driven by an RMS voltage exceeding its threshold turn-on voltage.

Several factors affect the voltage/gray level transition curve characteristics. These factors are inherent in the design and construction of the display and in the ambient environment of the display. Among the inherent factors affecting the voltage/gray level transition curve are:

1. Material Characteristics
a. Electro-optical characteristics of the particular liquid crystal material
b. Electrical characteristics of the barrier layers between the electrodes and the liquid crystal material
c. Electrical resistance of the electrodes
d. Viscosity of the liquid crystal material
e. Elasticity constraints.

2. Display Design
a. Thickness of the liquid crystal film in the display
b. Size, type and placement of the spacers in the display
c. Alignment angle and anchoring characteristics of the liquid crystal film and the barrier surfaces
d. Area and layout of the individual pixels 3. Ambient Conditions
a. Voltage of the applied drive signal
b. Existing gray level of the pixel
c. Ambient temperature of the display
d. Status of the neighboring pixels It is important for the designer of a display driver to understand these inherent characteristics of a display that influence the shape of the electro-optic turn on and turn off curves. Such an understanding helps to design a driver which offers improved display quality and image predictability.

All existing LCD controllers, including the present invention, are open loop controllers (i.e. the display controller has no feedback from the actual display). One of the innovations of the present invention is the simulation in real time of the characteristics outlined above. The display controller refers to the real time simulation to obtain key information to determine the drive signals for the display. This allows the impact of these characteristics to be included in the computations used to determine the drive signals for the display. Proper use of the simulation allows a greater number of pixels to be driven to a greater number of gray levels with greater accuracy. Employment of the present invention in color displays will allow a greater number of colors to be displayed with greater accuracy.

Throughout this patent application, reference is made to "real time" driving and/or control signal generation. "Real time" means that the drive signals are applied as generated by the control system as a continuous response to the most recent demanded image. Additionally, the present invention can apply drive signals to the array of rows and column electrodes "asynchronously", which means that there is now a preset sequence of activating rows or columns. The requirements of timing cycles, frame sets, or preset sequencing cycles as practiced in prior art for controlling the application of the control drive signals to the pixels, and for assuring that all DC bias is neutralized within one frame set, are not necessary in the practice of the present invention. This is made possible in the present invention by the use of real time computations and memory storage means which enables display simulation and DC bias tracking.

In sum, the prior art generally drives row and column electrodes in a predetermined sequence and according to a clock synchronized with the prior art AC signal. The present invention allows pixels to be driven selectively and in any sequence (e.g. synchronous, asynchronous, multiple backplanes selected, skipped backplanes), The order in which the pixels are driven is determined by underlying principles of this invention.

Prior art display drive controls, when faced with the requirement of ever increasing numbers of pixels to control, have adopted an approach of driving the display harder. That is, higher voltages are used with faster drive signals, as described above. This approach to servicing increasing numbers of pixels is a result of considering the LCD as an RMS responding device driven by AC wave forms. As will be described hereinafter, the present invention operates LCDs as DC voltage integrating devices. This approach overcomes several limitations inherent in the RMS responding approach. As discussed previously there is a limitation on the number of pixels which can be controlled and the number of gray levels which can be displayed using these prior art control schemes. These limitations are explained in "Scanning Limitations of Liquid-Crystal Displays" by Paul M. Alt and Peter Pleshko, *IEEE Transactions on Electron Devices*, February, 1974, pages 146–155, and "Reduction of Brightness Non-Uniformity in RMS Responding Matrix Displays", by T. N. Ruckmongathan, P. H. Verheggen, and Th. L. Welzen, *Proceedings The Society for Information Display*, Sep. 25–27, 1990.

As described in these papers, the number of backplanes in a display increases as the number of pixels increases. Servicing an increasing number of backplanes using prior art dictates a decreased amount of time available to service each backplane, and the decreased time available results in a corresponding decrease in controllability.

The present invention is not constrained by this trade off between number of backplanes and controllability. As will be shown, the amount of time available to service each backplane does not necessarily have to decrease as the number of backplanes increases.

The present invention eliminates some operating characteristics of prior art display controllers. These are:

Characteristic 1. Any net DC bias on the pixels must be neutralized within one drive cycle or one frame cycle;

Characteristic 2. Only one backplane can be selected at a time;

Characteristic 3. The backplanes must be driven sequentially in a regularly repeating frame cycle;

Characteristic 4. The functions of backplane and segment plane in the rows and columns are fixed; that is, they can not be interchanged selectively in real time;

Characteristic 5. Gray levels are produced by generating set proportions of full on signals (i.e. at or above the saturation voltage) and full off signals (i.e. below the threshold voltage) at a given pixel on a frame by frame basis ("interframe modulation")

The means by which the present invention eliminates the above characteristics, and the associated implications for improved display quality are described hereinafter.

An object of this invention is to provide a display drive control which operates without being hindered by any of the above prior art operating characteristics.

Another object of the invention is to provide an LCD display with improved imaging capabilities.

Still another object of this invention is to provide such an LCD display in which contrast, viewing angle and imaging capabilities as well as animation capabilities is improved over the prior art.

Another object of the present invention is to provide such an LCD display which reduces power consumption in relationship to the achieved image, is more versatile, provides greater clarity, increases the life of the LCD elements and is able to handle a larger number of pixels.

Still another object of this invention is to drive the pixels as DC voltage integrating devices.

Other objects and advantages and features of this invention will become more apparent hereinafter.

SUMMARY OF THE INVENTION

The above objects are accomplished by providing a system to drive a plurality of pixels, generally addressable as rows and columns, said system including memory means and computation means to simulate the condition of the display in real time and to store in memory representations of the current electro-optical conditions of the pixels and the net accumulated DC bias on the pixels. Additionally, the system includes means to determine and compensate for varying ambient temperature conditions as part of the ability to drive and control the display. Still further, the system employs means to generate a drive signal for each pixel in response to the most recent demanded image and the current status of the pixels in the display as represented in the simulation. Further, the system can refer to the simulation to determine the level of gray on pixels which are proximate to a pixel being driven and can adjust the voltage drive signal applied to the pixel to maintain better the demanded gray levels of the proximate pixels.

Four specific innovations are employed in present invention which eliminate the limitations imposed by the assumptions of prior art:

1. Use of memory means to store and update information on the display elements such as accumulated bias and present gray level;

2. Use of real time control and simulation techniques to calculate optimal or near-optimal drive signal patterns in real time;

3. Use of power modulation techniques which allow a greater variety of voltage levels to be used to generate the additive and subtractive drive signal levels to be used to drive the pixels;

4. Selective drive signal means enabling non-sequential and multiple addressing of the electrodes and interchange of the functions of backplane and segment plane between the row and column electrodes.

By employing memory and computation means to simulate the array of pixels, individual pixels can be driven selectively in accordance with the desired or demanded image to be displayed and in accordance with other parameters which affect displays. In particular, as described above, the MBVT is a level which must be considered in driving the display. In the prior art, MBVT is avoided by repetitively reversing the polarity on the entire display at a relatively high frequency so as to prevent any DC bias violations. In the present invention, the MBVT for each pixel is identified, and the accumulating bias on the pixels is represented in memory and updated in real time. Thus, the polarity of the drive signals does not need to be reversed until one or more pixels approach MBVT. At that time the bias reconciliation process is initiated and the display controller reverses polarity. The accumulated bias on the pixel(s) begins reducing towards zero and then begins to accumulate in the opposite polarity until the cycle repeats and some pixels approach MBVT in the opposite direction. Bias reconciliation is an exception process in the drive control flow which is initiated when the MBVT condition is met.

The present invention determines the order and manner in which to apply drive signals to the electrodes based on the difference between the present state of the display and the most recent demanded image. The order and manner in which drive signals are applied is continually recomputed based on these considerations.

The ability to selectively alter the drive signals and drive scheme in real time in response to the state of the display by employing memory and computation means to simulate and provide representations of each pixel represents a significantly different approach to providing visual images on liquid crystal displays.

In prior art, the display controller does not look at the new demanded image until it has completed drawing the present frame set. (In some instances, this can result in an image being skipped if another demanded image comes in from the host before the display's update frame cycles have been completed.) Thus, in prior art, there is a latency period (the time of the full frame cycle) which must elapse before the display can begin to show a new demanded image. In the present invention the concept of fixed frame cycles is eliminated. The system looks at the most recent demanded image in its entirety and compares it to what is presently on the display (or more specifically, to the simulation of what is on the display) and generates an optimal or near-optimal drive sequence to make the display substantially conform as quickly as possible to the new demanded image. With this technique, latency periods between display updates are minimized and skipped images are eliminated. The controller continually compares the most recent demanded image to the condition of the display and determines a drive sequence to make the display look like the demanded image.

The following is a summary of how the operating characteristics outlined above became part of prior art and why they are eliminated in the present invention.

Characteristic 1. Most early liquid crystal displays employed "dynamic scattering" material. Dynamic scattering liquid crystal materials and early nematic liquid crystal materials had very low electrical resistance (on the order of $10^5$ W) compared to presently available liquid crystal materials which have resistances of $10^{15}$ W or more. The early materials with lower resistances allowed greater ionic transport during application of the drive signals, which caused relatively rapid electroplating of the electrodes and breakdown of the liquid crystal material.

Newer liquid crystal displays, in addition to having greater resistance, have thicker non-porous barrier coatings over the electrodes which tend to hold any transported ions (thus temporarily preventing destructive effects to the display) until polarity is reversed. At the time of polarity reversal, any ions which were transported will leave the barrier and begin to migrate towards the opposite side of the LCD. This effect is described in "Transport of Residual Ions and Rectification in Liquid Crystal Displays", Alan Sussman, *Journal of Applied Physics*, March, 1978, page 1131. Thus, with newer liquid crystal displays, relatively large net DC biases can accumulate before damaging effects of electroplating and electrochemical breakdown occur. The present invention takes advantage of that discovery by employing the new concepts of "Maximum Bias Violation Tolerance" (MBVT) and "Bias Reconciliation". Use of these concepts allows the drive signals to maintain a given DC polarity for a much greater duration than is maintained in prior art.

Characteristic 2. The prior art technique of selecting one backplane electrode at a time is simple to employ and allows for regular and frequent reversal of the drive polarity to neutralize any net DC bias on the pixels. The present invention employs memory means to keep track of the bias status of the pixels in real time. Thus, the effects of multiple or skipped backplane selections can be accommodated.

Characteristic 3. The assumption that backplanes must be selected in a sequential, regularly repeating cycle is a consequence of adhering to prior art characteristic 2. Prior art drive controls, in the absence of display simulation and modeling techniques, are incapable of selecting backplanes in non-regular sequences. The ability to employ non-sequential, non-repeating backplane selections, including selecting multiple backplanes or skipping backplanes, adds an entire dimension to the drive control scheme.

Characteristic 4. Selectively interchanging the functions of backplane and segment plane drivers in real-time is not realistically possible in the prior art. The present invention achieves improved display quality by exploiting a larger set of drive capabilities and opportunities. The existing condition of the display and how the existing condition differs from the most recent demanded image will determine which set of electrodes is used as backplane and which is used as segment plane.

Characteristic 5. The assumption that interframe modulation is a necessary means for achieving gray levels is a consequence of prior art characteristic 1 (neutralization of DC bias within a frame cycle) and prior art characteristic 3 (fixed frame rates). Prior art display controllers, when-faced with an ever increasing number of pixels to drive, have been forced to compromise between gray levels and frame update speeds. Since slower frame updates produced obvious frame flicker which could not be tolerated, prior art has erred towards reduction in quality and number of gray levels which could be displayed. The present invention achieves increased numbers of gray levels with greater accuracy through a technique termed "Pixel Power Modulation" in which a pixel's energy level is maintained in a specific range as illustrated in FIG. 6.

U.S. Pat. No. 4,926,168, Liquid Crystal Display Device Having a Randomly Determined Polarity Reversal Frequency, Yamamoto et al, teaches the generation of a random number which is used for the count of each frame set. After the frame count, the polarity is reversed and identical but opposite drive signals are applied for an equal number of frames to neutralize any DC bias. Polarity reversal in the present invention is not tied to any set number of frames, but is associated with the accumulating DC bias violation of the pixels.

Another approach taken by prior art controllers to attempt to meet the demands for servicing an increasing number of pixels at acceptable update rates has been to fabricate active electronic components on the display with the intention of improving the threshold characteristics and charge storage characteristics of the display. These active matrix displays improve the display quality over that of the passive matrix while continuing to employ prior art display control technology. Although the use of active matrix displays expands the envelope of display performance somewhat, these display systems suffer from the same limitations (stemming from the five characteristics outlined above) as do passive matrix displays. The new techniques and concepts employed in the present invention (bias status memory, display status simulation in memory, DC bias violation, maximum bias violation tolerance, bias reconciliation, selective real time drive sequencing, and pixel power modulation) provide improved display performance for both passive matrix and active matrix displays.

Implementation of these techniques and concepts as taught in the present invention enables the employment of several new drive addressing techniques which are not available in prior art. These new drive addressing means can be grouped into two classes. The first group are referred to as "addressing with full saturation drive". The second are referred to as "pixel power modulation drive". All the new drive techniques taught employ DC bias violation memory and bias reconciliation means. These drive schemes also differ from prior art in that they do not require frequent complementary reversals of drive polarity. The pixels are driven across the zero voltage condition only as often as necessary, as dictated by the MBVT condition. These new drive addressing means are as follows:

Addressing with Full Saturation Drive. The drive means included in this group all use the full saturation drive technique of prior art. That is, the drive signals are designed so that the additive drive voltages between the row and column electrodes are above the threshold drive voltage of the display, and the subtractive drive voltages between the row and column electrodes are below the threshold voltage. Five new addressing means are included in the full saturation drive category.

1. One line at a time sequential saturation voltage drive. In this drive technique one backplane electrode is selected at a time in a fixed sequential order, and the segment electrodes are selected as required for each backplane. This drive scheme differs from prior art in the following ways: (1) It is not necessary for polarity reversal to occur during every frame or every frame set, as is taught in prior art. Rather, polarity reversal occurs when MBVT is reached or approached. (2) Pixel status can be updated immediately upon receipt of a new demanded image, even in mid frame. Pixel updates do not have to be delayed until an even number of frames have been completed as is taught in prior art.

2. One line at a time demand driven saturation voltage drive. In this drive technique one backplane electrode is selected at a time, and the order in which the backplane electrodes are selected is determined selectively and in real time by the drive controller. The drive controller determines a drive sequence for the electrodes which corresponds to the immediacy of the need for refresh for the pixels associated with each electrode. This drive scheme differs from the previous scheme in that a new element of flexibility is added. Specifically, the order in which the backplane electrodes are addressed, the frequency with which they are addressed, and the duration of the pulse applied to each of them is not fixed or predetermined, but rather is continuously determined, updated, and implemented by the drive controller to address the continually changing needs of the display (i.e. the demanded gray levels of the pixels and the distribution of those gray levels on the display).

3. One line at a time demand driven saturation voltage drive employing selective interchange of functions of row and column electrodes. This drive means employs an additional feature to the above in that the backplane and segment plane functions of the rows and columns can be selectively interchanged in real time by the display controller. This adds a further degree of flexibility to the drive scheme. The controller can determine whether it is more efficient to use the row electrodes or the column electrodes in the function of backplane to achieve the demanded distribution of gray levels of the pixels.

4. Multiple line demand driven saturation voltage drive. This drive means expands on drive means number 2 described above in that more than one electrode can be selected at a time in the function of backplane. This adds yet a further element of flexibility to the drive scheme.

5. Multiple line demand driven saturation voltage drive employing selective interchange of functions of row and column electrodes. This drive means expands on drive means number 4 described above in that the functions of backplane and segment plane can be selectively interchanged in real time between the row and column electrodes by the display controller. This drive scheme offers the greatest flexibility to the drive controller of the several full saturation drive schemes taught in this invention.

Pixel Power Modulation Drive Means. The drive means included in this group all differ from prior art in the following manner. "Pixel Power Modulation" (PPM) (see FIG. 5) is a technique in which selective voltage bands are associated with particular gray levels. Drive pulses are Selectively applied to the pixels to maintain their energy within the desired gray level band. As mentioned previously, the energy bands are not uniformly spaced, but are distributed according the electro-optic characteristics of the particular display (see FIG. 6), and are corrected for ambient temperature. (See FIG. 4 for an illustration of the variation in electro-optic characteristics as a function of applied voltage and temperature.) With pixel power modulation drive means, voltages are applied to the row and column electrodes in such a way as to maintain the opacity of the pixel within a specified gray band which corresponds to the demanded gray intensity of the pixel. The voltages are applied to the electrodes using techniques of modulating the pulse width, pulse frequency and pulse amplitude of the applied drive voltages. This differs from prior art drive schemes which drive the pixels using the full saturation voltage scheme described above. In PPM, pixels are modulated by the use of many drive pulses applied in rapid succession. The effect is similar to that required in modulating the storage element of a switching power supply. It is not one pulse which produces the desired voltage level, but the integrated effect of many applied pulses. Five new addressing means are included in the pixel power modulation category. They are analogous to the five full saturation voltage drive schemes described above, with the substitution of pixel power modulation drive techniques for full saturation voltage driving.

1. One line at a time sequential pixel power modulation drive. In this drive addressing means one backplane electrode is selected at a time, and the backplane electrodes are selected sequentially using pixel power modulation to apply drive voltages to the electrodes to maintain the pixels within targeted gray bands. Polarity is reversed when a pixel or pixels approach MBVT.

2. One line at a time demand driven pixel power modulation drive.

In this drive addressing means one backplane electrode is selected at a time, and the order in which the backplane electrodes are selected is determined by the drive controller. The drive controller determines a drive sequence for the electrodes which corresponds to the immediacy of the need for each electrode to be addressed. The drive signals are applied using pixel power modulation techniques.

3. One line at a time demand driven pixel power modulation drive employing selective interchange of functions of row and column electrodes. This drive means differs from the above in that the functions of backplane and segment plane can be selectively interchanged in real time between the row and column electrodes by the display controller. This adds a further degree of flexibility to the drive scheme. The controller can determine whether it is more efficient to use the row electrodes or the column electrodes in the function of backplane to achieve the demanded distribution of gray levels of the pixels. The drive signals are applied using pixel power modulation techniques.

4. Multiple line demand driven pixel power modulation drive. This drive means differs from pixel power modulation drive means number 2 described above in that more than one electrode can be selected at a time in the function of backplane. This adds yet a further element of flexibility to the drive scheme. Again, the drive signals are applied using pixel power modulation techniques.

5. Multiple line demand driven pixel power modulation drive employing selective interchange of functions of row and column electrode. This drive means differs from pixel power modulation drive means number 4 described above in that the functions of backplane and segment plane can be selectively interchanged in real time between the row and column electrodes by the display controller. This drive scheme offers the greatest flexibility to the drive controller of the several pixel power modulation drive schemes taught in this invention.

Another matrix display to be considered is an active matrix LCD display (AMCLD) which can be visualized as a matrix of addressable active devices (MOSFETs or diodes) which in turn directly address their associated pixels in reference to the backplane electrodes. The characteristic rate of dissipation of charge across the pixels in AMLCDs is slower than dissipation of charge in passive matrix LCDs. In AMLCDs, the charge across pixels dissipates too slowly to allow a pixel to decay passively to a lower gray level quickly enough for animated displays. This slower rate of charge dissipations is due to the parasitic capacitance of the active device and the associated capacitor fabricated on the thin film layer. Additionally, the discharge path through the active matrix device is closed, which allows very small current leakage. The discharge rate of charge across the pixels of an AMLCD ranges from approximately 5% to 20% of the initial charge in 1/30th of a second.

Thus, to achieve pixel power modulation in AMLCDs, it is necessary to apply active discharge techniques to the pixels to drive them to lower gray levels quickly enough to achieve acceptable viewing characteristics. (This is in addition to the pixel power modulation techniques previously described for maintaining desired gray levels.) Active discharge of the pixels to drive them quickly to lower energy levels is achieved by selecting the gate electrode of the transistor at the desired pixel and applying reverse polarity to the source electrode. In AMLCDs the designation of the source and drain electrodes are sometimes reversed depending on the material from which the active thin film is fabricated, e.g. from polysilicon vs. amorphous silicon.

The ten addressing and driving techniques previously described for passive matrix LCDs are also applicable to AMLCDs with the addition of the following two features:

1. Individual AMLCD pixel can be driven with selective voltages in either polarity.

2. The polarity of the entire display need not be reversed at once. Rather, the polarity of individual pixels can be reversed selectively. This allows active discharge as described above, and allows selective bias reconciliation.

A detailed description of the invention is set forth hereinafter, and the above objects are addressed in greater detail in the following description.

DESCRIPTION OF PREFERRED EMBODIMENT

Figure 1:
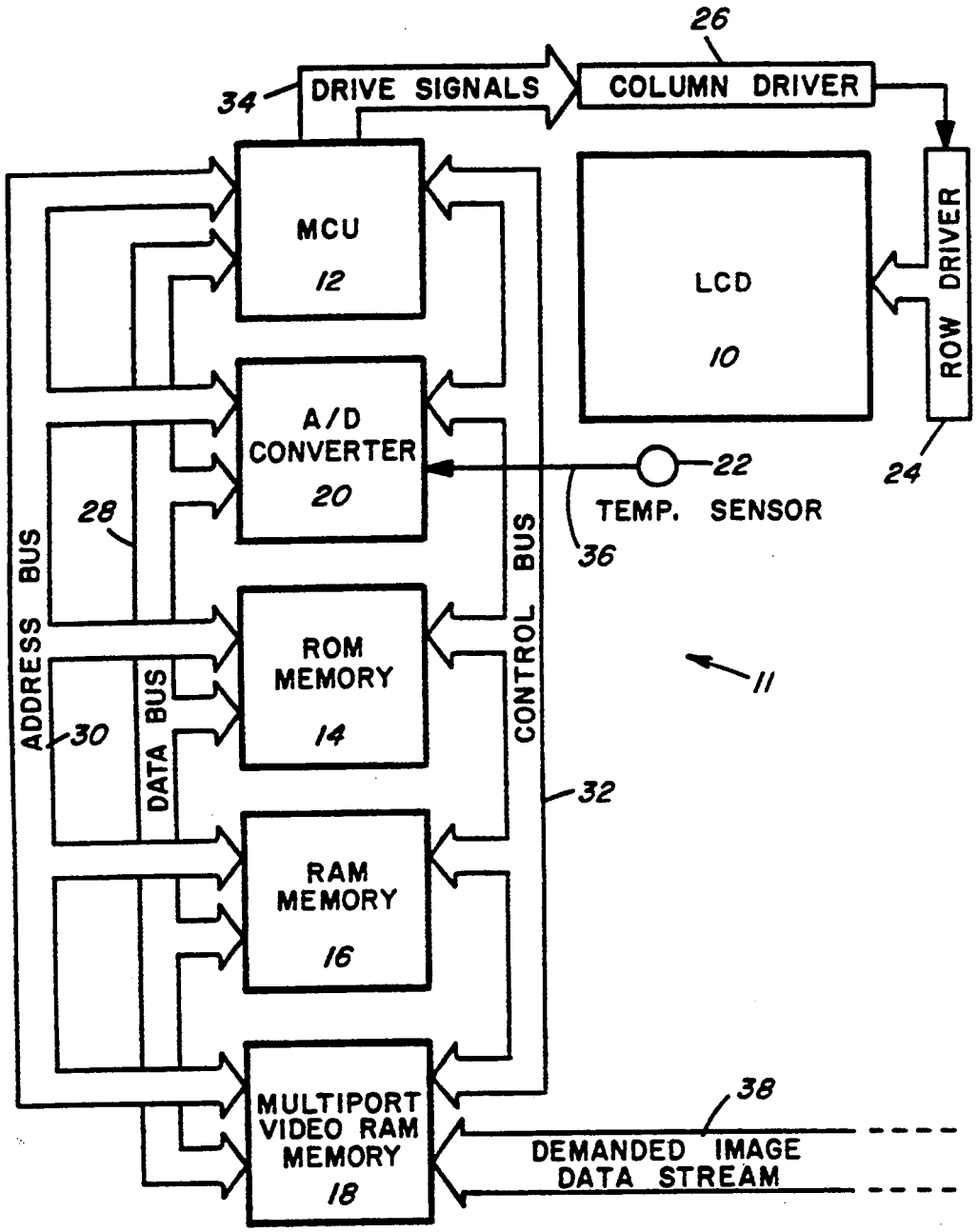
FIG. 1 is a block diagram illustrating an embodiment of the present invention.
Figure 2:
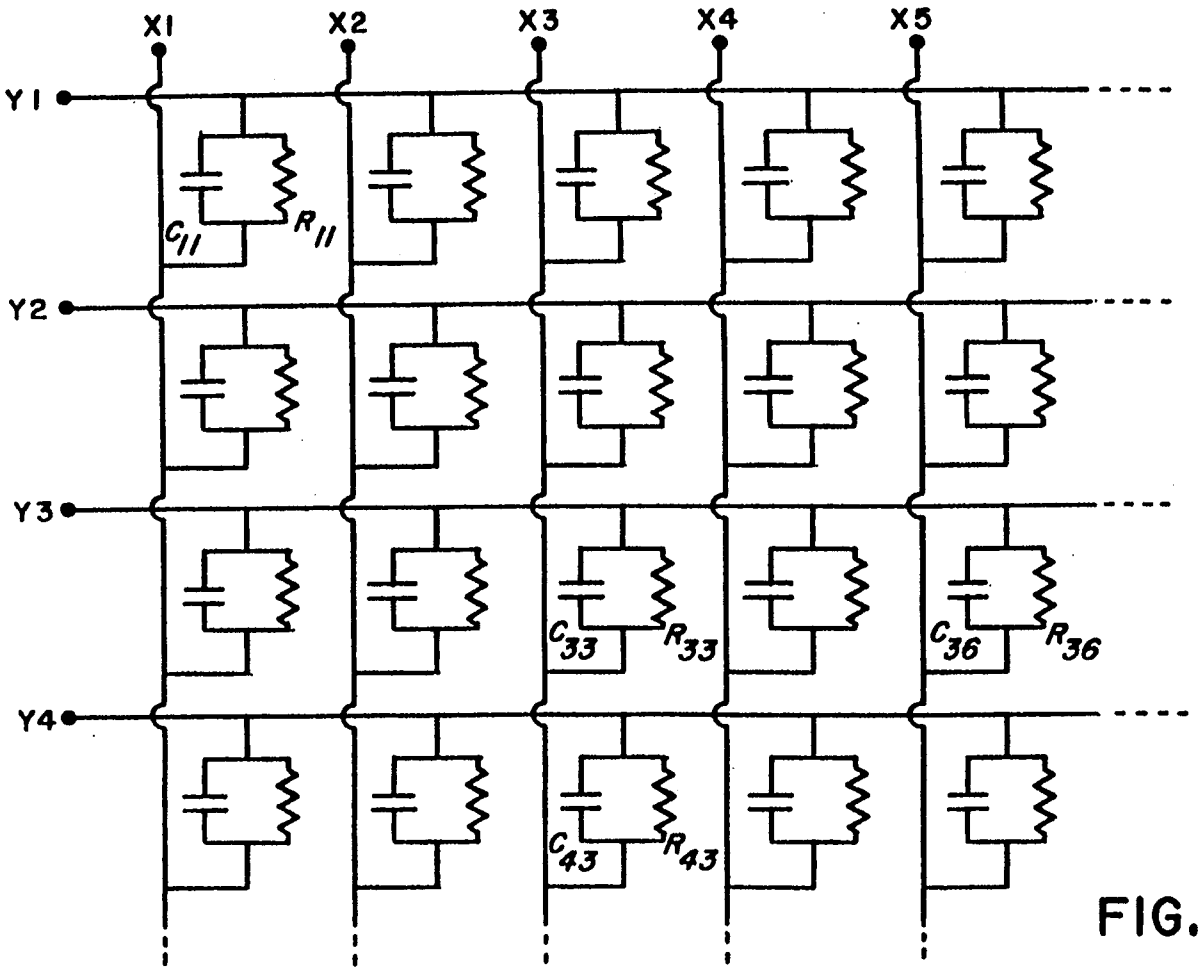
FIG. 2 graphically illustrates the electrical nature of passive matrix liquid crystal displays as an array of slightly leaky capacitors.

FIG. 1 is a block diagram showing an embodiment of the present invention. FIG. 1 portrays a complete display system of a liquid crystal display 10 (LCD) and "display controller" (the remainder of the components shown in FIG. 1). The LCD 10 can be either a passive matrix or an active matrix type. When the display LCD 10 comprises a passive matrix type, it may comprise a plurality of individual pixels arrayed in rows and columns, as illustrated in FIG. 2. When the display LCD 10 comprises an active matrix type, it may comprise a plurality of individual pixels with associated active devices, as illustrated in FIG. 3. The display controller 11 includes the following components: microcontroller unit (MCU) 12; program ROM memory 14; read/write RAM memory 16; multiport video RAM memory 18; analog to digital (A/D) converter 20; temperature transducer 22; and row and column drivers 24 and 26 respectively. The interconnections among these devices are also illustrated, including: data bus 28; address bus 30; control bus 32; drive signals carried on an interface 34 to the row and column drivers 24 and 26 from the MCU 12; connection 36 from temperature transducer to A/D converter 20; and incoming data stream 38 from the device generating new image data.

The component specifications for this embodiment are as follows:

The MCU 12 is the MC68332 manufactured by Motorola Semiconductor, Phoenix, Arizona, USA. The MC68332 is a 32 bit wide microcontroller designed for real time control applications.

The ROM memory 14, in which the drive and control program and parameters reside, is composed of TC53H1024P-85 integrated circuits manufactured by Toshiba America, Tustin, Calif., USA. The TC53H1024P-85 is a high speed Read Only Memory organized as 65,536 words by 16 bits.

The multiport video RAM memory 18 comprises TMS44C251 integrated circuits manufactured by Texas Instruments, Dallas, Tex., USA. The TMS44C251 is configured as 262,144 by 4 bit dual port accessible DRAM.

The RAM memory 16 comprises TC514100AP CMOS integrated circuits manufactured by Toshiba America, Tustin, Calif., USA. The TC514100AP is organized as 4,194,304 words by 1 bit.

The row and column drivers 24 and 26 are composed of HVO4 integrated circuits manufactured by Supertex, Inc., Sunnyvale, Calif., USA. The HVO4 is a 64 channel serial to parallel converter with high voltage CMOS outputs.

The analog to digital (A/D) converter 20 is the MAX177 manufactured by Maxim Integrated Products, Sunnyvale, Calif., USA. The Max177 is a CMOS 10 bit A/D converter with track and hold reference functions built on chip.

The temperature transducer 22 is the MTS102 manufactured by Motorola Semiconductor Products, Phoenix, Ariz., USA. The MTS102 has a 2° C. temperature accuracy over the temperature range −40° C. to +150° C.

In the following description, the functional blocks are sometimes referred to by the specific illustrated components identified above in the manner with which one of ordinary skill in the art would be familiar.

For completeness, the arrangement of the blocks is set forth hereinafter. Address bus 30, data bus 28 and control bus 32 are each connectable as inputs or outputs, as appropriate, to any of the five blocks, that is, the multiport video RAM memory 18, the RAM memory 16, the ROM memory 14, the AD converter 20 and the MCU 12. Demanded image data stream 38 is supplied as an input to multiport video RAM memory 18.

LCD 10 is connected to and driven by row and column drivers 24 and 26, and the row and column drivers are also connected together. Row and column drivers 24 and 26 are connected to microcontroller 12 with drive signals 34 supplied by the microcontroller 12 to column driver 26.

Temperature sensor 22 is connected by line 36 to A/D converter 20.

The operation of the controller is as follows. The demanded image (i.e. the new image to be portrayed on the LCD 10) is input asynchronously via the input stream 38 and is loaded into the multiport video RAM memory 18. Each byte of video memory corresponds to one pixel of the demanded image. The numerical value of each byte represents a particular gray level. For example, a 0 represents white, a 127 indicates black, and a 64 indicates a 50% gray level. The numerical representation of the demanded image in the video memory is termed the "demanded image array".

The demanded image that is input can be any digitized image signal, including but not limited to: a digitized television signal; digitized graphics generated by any graphics hardware/software combination; or any digitized image generated by an imaging device. The demanded image data is stored at specific ordered addresses in the demanded image array (i.e. in the video RAM memory 18) in a manner which corresponds to the format of the pixels on the LCD 10.

The RAM memory 16 contains several blocks of memory employed for computing the drive control schemes. One block of memory is termed the "simulated image array". In the simulated image array each byte of memory corresponds to one pixel in the actual LCD 10, with the numerical value of each byte representing a gray level as described above. The simulated image array is continually updated in real time to reflect the real time status of LCD 10. This provides a means for the open loop control methodology. The format and order of the arrangement of the bytes of memory in the simulated image array is identical to the format and order of the bytes of memory in the demanded image array (stored in the VRAM video RAM memory 18). In particular, both these blocks of memory correspond to the format of the pixels on LCD 10.

A second block of RAM memory 16, termed the "pixel bias violation array", is dedicated to keeping track of the net DC bias on the pixels. This block of memory is ordered the same as the demanded image array and the simulated image array, in that one byte is assigned to each pixel, and the arrangement of this block of memory corresponds to the format of the pixels on LCD 10. Numerical values are assigned to each memory byte in the pixel bias violation array on a real time basis to represent the current accumulated DC bias and polarity on each pixel. These values, which range from −127 to 128, are used by the controller 11 to determine when MBVT has been reached.

A third block of RAM memory 16 is termed the "difference array". This block of memory is also laid out to correspond to the distribution of the pixels in LCD 10. The values stored in the difference array represent the difference in gray level between the most recent demanded image (as represented in the demanded image array) and the present gray levels of the display pixels (as represented in the simulated image array). The means of computing the difference array is described hereinafter.

Figure 4:
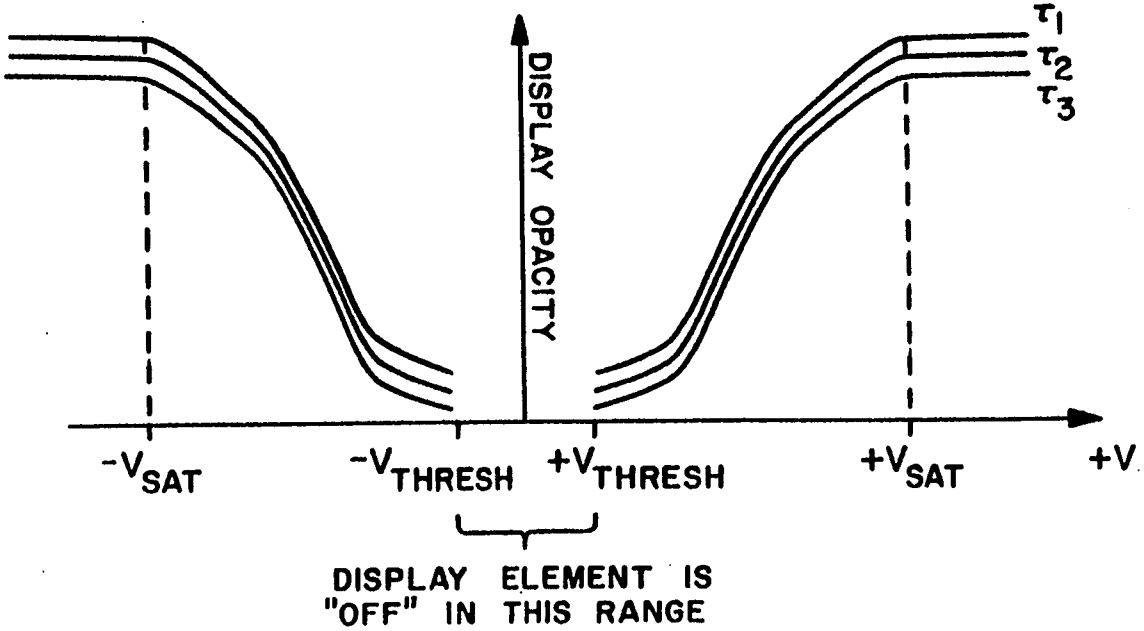
FIG. 4 illustrates the relationship between the voltage applied to a liquid crystal pixel and the opacity of the pixel, and how that relationship changes with changing ambient temperature.

The MCU 12 generates the drive scheme which causes the demanded image to appear on the LCD 10. Program instructions and parameters stored in the ROM memory 14 direct the operations of the MCU 12, which are illustrated in the flow chart comprising FIG. 7. Following the initialization sequence, the MCU 12 begins operations by accessing the A/D converter 20 and reading the ambient temperature of the LCD 10. This temperature value, which is re-read periodically during operation of the LCD 10, is used to compensate for changes in the physical characteristics of the LCD 10 which vary with changes in temperature, as illustrated in FIG. 4. The temperature value which MCU 12 reads is compared to a look-up data table stored ROM memory 14, where "compensating values" are read which dictate how the drive computation parameters should be altered to compensate for variations in ambient temperature.

The MCU 12 next executes a routine to calculate a byte by byte difference between the values stored in the simulated image array and the values stored in the demanded image array. To do this, MCU 12 accesses the memory values in the portion of RAM memory 16 dedicated to the simulated image array of RAM memory 16 and compares those values with the corresponding values in the video RAM memory 18. The MCU 12 determines a numeric difference between the corresponding values in memory by using known techniques such as comparison, arithmetic, and logical operation. These computed values represent the difference between the current gray level of each pixel on the LCD 10 and the demanded gray level of each pixel. These computed values are then stored in a memory block set aside in RAM memory 16 as the "difference array". The various memory elements (RAM memory 16, ROM memory 14, and video RAM memory 18) are written to and read from using known means of memory access employing the data bus 28, the address bus 30, and the control bus 32 signals. The video RAM memory 18 is specified as multiport so that the MCU 12 can read from the video RAM memory 18 by one port while a digital image enters via another port.

The MCU 12 communicates the drive patterns and signals to the row and column drivers 24 and 26 through the queued serial interface (QSI), which is an on-chip subsystem on the MCU 12, and through the function control lines. The sequence of actions required to communicate the drive signals to the row and column drivers 24 and 26, is as follows: The latch enable pin (LE) on the HVO4s of the row and column drivers 24 and 26 is brought to a low logic state by means of outputting a low logic state on function pin 1. The binary data representing the drive signals are transmitted from the MCU 12 using the QSI and the on-chip time processor unit (TPU) of the MCU 12. The data are transmitted to the "data in" pin on the HVO4 and are synchronized on the HVO4's "clock" pin. The rate of data transmission in this embodiment is limited to a maximum of 8 MHz, a constraint imposed by the maximum throughput of the HVO4. During each clock period, one bit position is loaded and shifted into a 64 bit shift register which is on the HVO4. (A plurality of HVO4s may be employed without a need for additional control lines from the MCU 12. This is achieved by arranging the HVO4s serially in such a manner that the "data out" pin of a preceding HVO4 is connected to the "data in" pin of the succeeding HVO4.)

Thus, the drive signal data are computed by the MCU 12 and loaded into RAM memory 16. The drive signal data are represented by a number of bits equal to the combined number of row and column electrodes. Once the entire sequence of drive signals are loaded into RAM memory 10, they are shifted into the HVO4 shift register(s). After all these bits have been clocked and shifted into the row and column drivers the MCU 12 brings the LE pin on the HVO4(s) high. This latches the data internally in the HVO4(s) and makes the corresponding drive signals available on the output drive lines which are connected to the row and column electrodes of the LCD 10. Bits which were set to one will have their corresponding electrode driven to high voltage, and bits which were set to zero will have their corresponding electrode set to low voltage. For the purposes of this embodiment, low voltage is zero volts and high voltage can be set to any level between five and thirty volts as per the specifications of the HVO4.

This drive scheme as described and illustrated is capable of generating drive patterns which employ pulse width modulation, pulse frequency modulation, and combined pulse width/pulse frequency modulation as applied to the electrodes of the LCD 10. The generation of a drive pattern which also employs pulse amplitude modulation requires substitution of the HVO4s with circuits such as multiple digital to analog (D/A) converters, multiple signal level multiplexers,or other addressable amplitude modulating circuits. Use of multiport digital to analog (D/A) converters would provide the necessary output signals. Employment of pulse amplitude modulation enables an additional level of flexibility in display drive control, which translates into improved display controllability and therefore improved display quality. Employment of D/A converters or other addressable amplitude modulating circuits at the row and column electrodes is an alternative to the use of serial to parallel converters as illustrated. One means of accomplishing a large number of D/A converters addressable as shift registers is to employ the semi-custom Linear/Digital Master Chip available from Exar Corporation, San Jose, Calif., USA. The modulation of frequency, width, and amplitude of the drive pulses is performed in such a manner that the integration of the pulses applied to the row and column electrodes achieves the desired voltage level across the pixels.

In this embodiment, one of the controller's instructions is to keep every pixel energy level within the gray tolerance band of its specified gray level. This contrasts sharply with prior art techniques, in which all pixels continually fluctuate between all gray levels, from full on to full off, regardless of the demanded gray level of the pixel. These extreme fluctuations are inherent in the AC wave form drive techniques of prior art.

Another problem plaguing prior art LCD drive techniques is limited viewing angle of the displays. The present invention maximizes the viewing angle of LCDs by means of maintaining the pixels within a gray band rather than driving the pixels continuously from fully black at one extreme of drive polarity, across the zero voltage condition, to the black at the other extreme of drive polarity.

System Operation

Control and operation of the display system shown in FIG. 1 must occur within the requirements, limitations, and resources of the system. These are illustratively described as follows.

The requirements of the display system are:

1. Each pixel must be maintained within the tolerance band of the demanded gray level. This is necessary to produce the desired image.

2. The bias which accumulates on each pixel must be simulated and monitored to prevent any pixel from reaching MBVT. This is required to avoid display degradation.

3. All pixels must achieve a new demanded gray level within 1/45to 2/45of a second of the demand. This speed is necessary for animated displays. For more static images, such as most computer displays, this requirement can be relaxed to as much as ½second.

Inherent limitations of the display system are:

1. The display control system is open loop. The display simulation means taught in the present invention render improved control of the LCD 10 as compared to prior art display control systems.

2. The computations which the MCU 12 must perform impose a latency period on the application of the drive signals to the electrodes. The shorter the duration between updates of the drive controller (i.e. the faster the MCU 12 can compute new drive schemes), the better the performance of the LCD 10, as is explained below.

Inherent characteristics of the LCD 10 which the present invention utilizes as resources for operations are:

1. The electro-optic turn on curve of an LCD pixel is faster than its turn off curve. This characteristic enables the controller 11 to refresh a pixel (apply another voltage pulse across its electrodes) before the opacity of the pixel has decayed below the lower tolerance of its specified gray band (see FIG. 6).

2. The liquid crystal molecules store energy in a manner similar to a damped oscillator, with the influx of energy coming from the application of an electric field applied across the electrodes of the pixels. This characteristic makes the pixel power modulation drive techniques effective.

3. The capacitance which is manifested at the junctions of the electrodes allows the power modulation techniques to generate selective RMS DC voltages across the pixels.

4. Various voltage levels can be applied to the pixels by the difference in potential formed by the voltage level of the row electrode and the voltage level of the column electrode.

5. Drive signals can be applied to the row and column electrodes in any order, and to multiple electrodes simultaneously.

Display Control

Referring to FIG. 1, when the display system is first powered on the image in the simulated array, which is stored in RAM memory 16, is blank. The first demanded digitized image is then loaded into the multiport video RAM memory 18 from the demand image data stream 38. A difference array is then computed as described previously, and is loaded into the difference array memory. (Note that in this special instance at start-up, the difference array is equal to the demanded image array, since the all values in the simulated image array are zero.) The MCU 12 then generates a drive pattern that will be applied to the row and column electrodes through the row and column drivers 24 and 26. The drive pattern corresponds to the binary sequence that is loaded into the row and column drive circuits as described previously. The length of the binary pattern is equal to R+C, where R represents the number of rows to drive and C represents the number of columns to drive.

Figure 7:
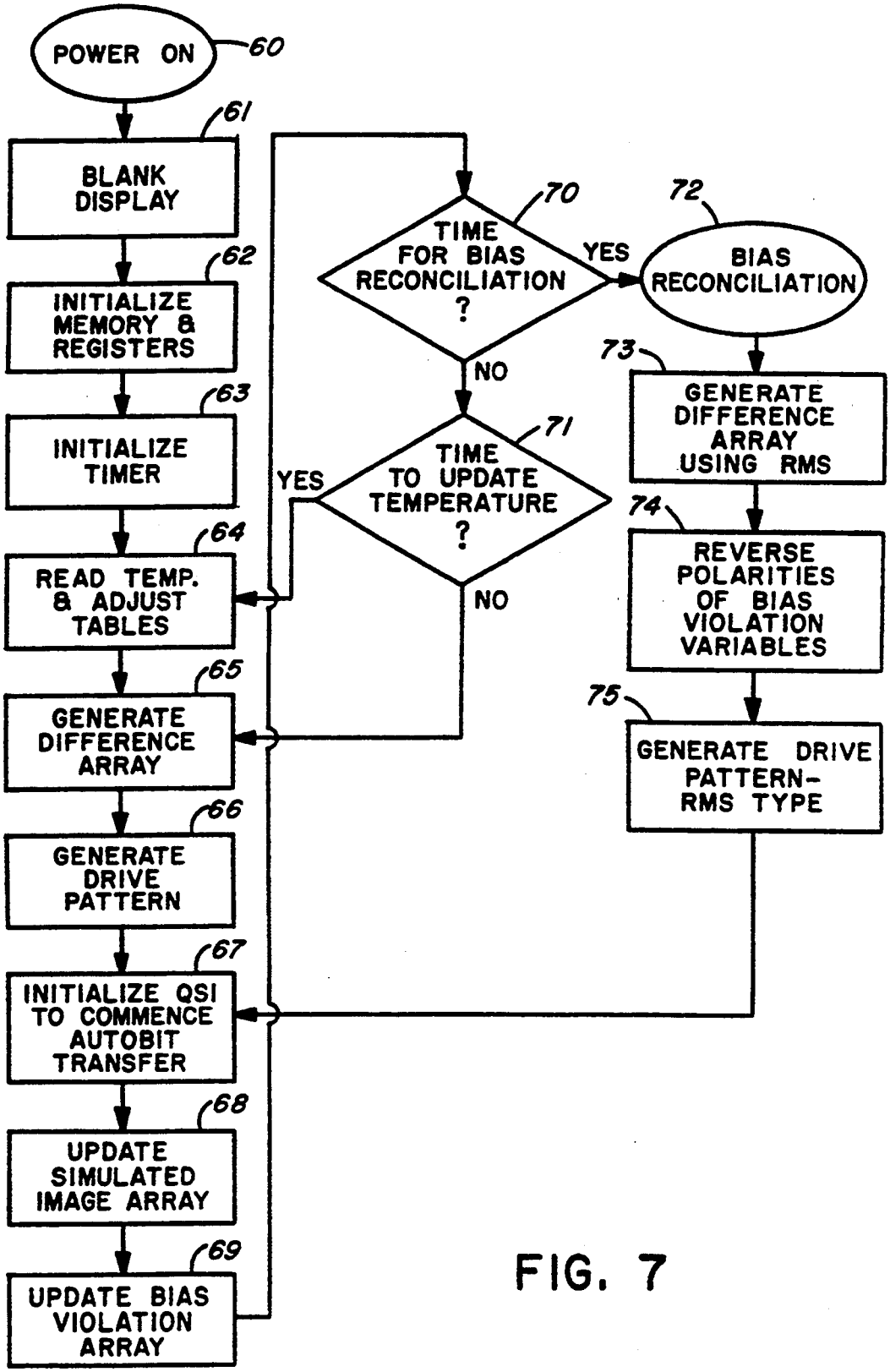
FIG. 7 illustrates the logic flow of the control system.

FIG. 7 is a flow chart of the program executed by the MCU 12 of the display controller 11. The instructions for this program are contained in the ROM memory 14.

As illustrated, operation is commenced with a blank display (block 61) after power is turned on (oval 60). The display remains blank until the MCU 12 completes the execution of the initialization process (blocks 62 and 63).

The initialization process (block 62) sets the processor registers, the RAM memory 16 and the registers in the drive circuits to known values. The RAM memory 16 contains the variables, pointers and memory arrays as explained previously. It is critical to initialize the RAM memory 16 to known values in order to enable proper program flow and proper accumulation of simulated values of gray levels and bias levels.

The timer component of the MCU 12 is next initialized (block 63) and set into execution. The MCU 12 as selected in the present embodiment employs a sophisticated timer caller the time processor unit (TPU) located on the CPU circuit substrate. The TPU executes in parallel with the CPU and is necessary for interval time measurement and accumulation. This capability enables the MCU 12 to calculate the gray levels and bias violation values since these functions are time dependent characteristics.

The MCU 12 next reads the display temperature as (block 64). The temperature value is used to update memory variables and pointers located in RAM memory 16. These variables and pointers work in conjunction with data stored in ROM memory 14 that define characteristics of the LCD 10 that vary with temperature.

As illustrated in FIG. 7, the operation of reading the display temperature is repeated continually throughout the operation of the controller 11.

The MCU 12 next generates the difference array (block 65) as previously explained. This operation determines the intensity to which the various pixels must be driven.

These intensity requirements for the individual pixels are necessary for the next operation, which is "generate drive pattern" (block 66). To generate the drive pattern, the MCU 12 must set up a sequence of drive voltages at the electrodes which produces the desired voltages at the individual pixels. The drive pattern is converted to a sequence of bit patterns which are stored in memory that, when loaded into the drive circuit (HVO4), will synthesize the desired drive pattern.

The next operation, "initialize QSI to commence auto-bit transfer" (block 67) causes the QSI circuit on the CPU substrate to transfer the memory array bit pattern to the driver circuits. Upon generation of the drive pattern, the MCU 12 updates the simulated image array and bias violation array in memory. These arrays are updated based on the generated drive pattern, the applied time duration and voltage levels, with corrections for temperature and the specific properties of the LCD 10 as stored in ROM memory 14. At this point in the operation, the drive pattern is output to the LCD 10, and the simulated gray levels and bias violation levels of the pixels are updated (blocks 68 and 69) and stored in the corresponding locations in RAM memory 16. The MCU 12 next determines (diamonds 70 and 71) if it is time for the bias reconciliation process (oval 72). The bias reconciliation process (oval 72) is initiated (the answer to diamond 70 is "yes") if the MCU 12 determines that any pixel or group of pixels are approaching their MBVT by comparing the simulated bias violation values of the pixels stored in memory.

If MBVT is not reached (the answer to diamond 70 is "no"), the MCU 12 next determines, in conjunction with the TPU, if it is time to update the temperature reading (diamond 71).

If a new temperature reading is required (the answer to diamond 71 is "yes"), the program execution will repeat the cycle from the "read temperature and adjust tables" operation (block 64). If no new temperature reading is required (the answer to diamond 71 is "no"), the MCU 12 will pass program execution to "generate difference array" (block 65).

The bias reconciliation routine (oval 72) begins as by generating an RMS difference array (block 73). The RMS difference array is unlike the difference array generated in the mainline program. As explained previously, the difference array generated in the mainline program is the difference between the present gray value of each pixel and the demanded gray value. This representation of the difference values is used to generate the drive signals.

The RMS difference array is a representation of the drive level and polarity required to drive a pixel during bias reconciliation. This includes driving each pixel temporarily to a gray level which is darker than the demanded gray level in order to compensate for the visual fade of gray levels which occurs as the pixels move towards and cross the zero voltage condition when driven to the opposite polarity.

Next, the MCU 12 reverses the polarities of the memory variables (block 74) by means of an arithmetic negation program instruction. This operation provides the means by which the MCU 12 can continue to employ the routines in the mainline program even though it is driving the LCD 10 in the opposite voltage polarity.

The MCU 12 next generates the RMS drive pattern (block 75). This pattern is created, as previously described, to avoid the problem of visual fade of gray levels when reversing polarity. Program execution then returns to "initialize QSI to commence auto-bit transfer" (block 67).

Figure 8:
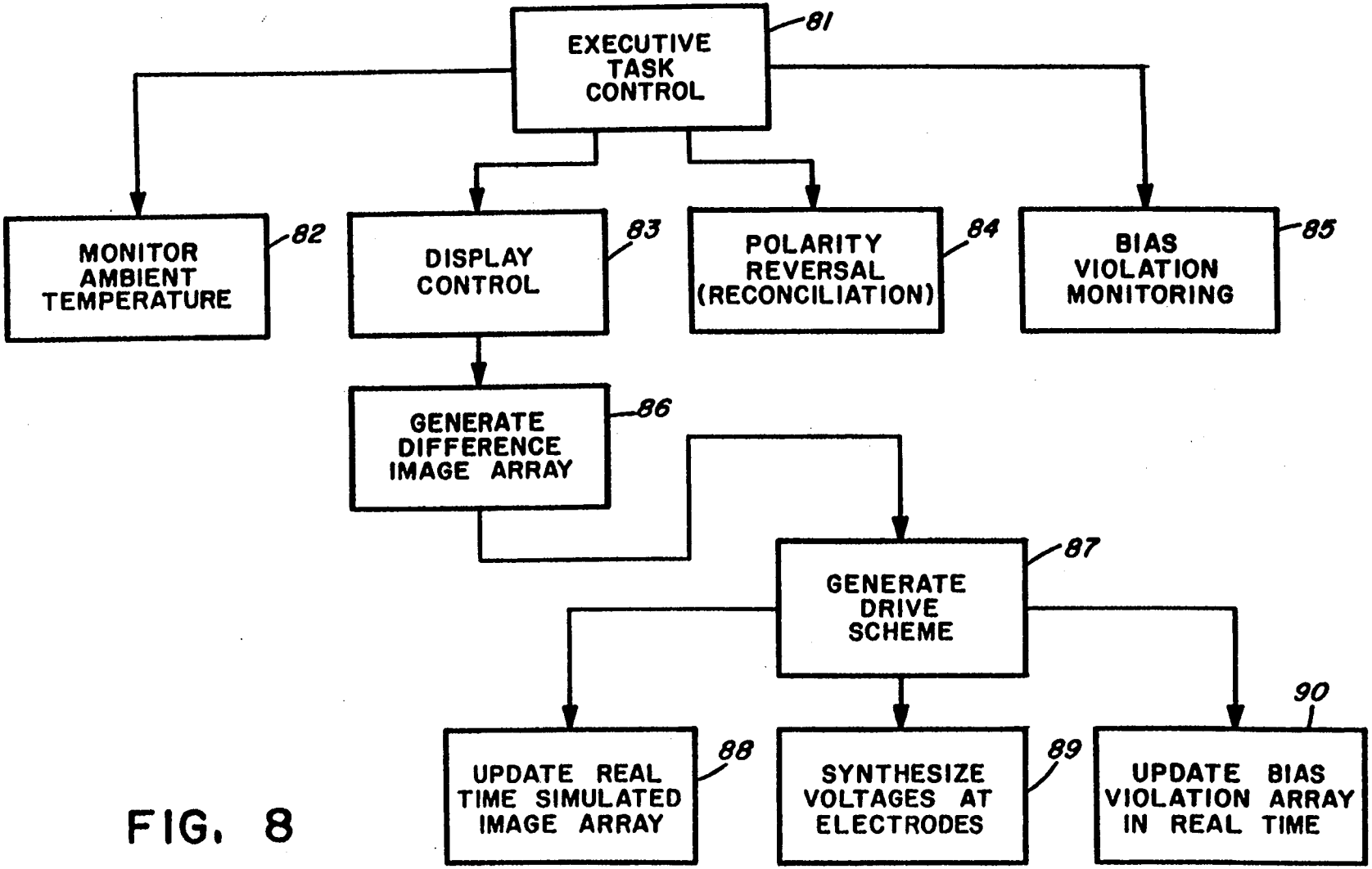
FIG. 8 is a task diagram illustrating inter-task control.

Referring to FIG. 8, the task control diagram, the executive task control 81 is the multitasking control which schedules the execution of the four major level control tasks. The major level control tasks are monitor ambient temperature 82, display control 83, polarity reversal 84, and bias violation monitoring 85. Execution of display control 83 occupies the majority of the control system time. Display control 83 calls the subtask 86, "generate difference image array", which in turn calls subtask 87, "generate drive scheme". The following subtasks are called by subtask 87: subtask 88, "update real time simulated image array". Subtask 89, "synthesize voltages at electrodes"; and subtask 90, "update bias violation array in real time". Subtask 87, "generate drive scheme", is responsive not only to subtask 86, "generate difference image array", but also to the specific parameters of the LCD 10 and to the specific drive technique which has been programmed into the controller" (e.g. multiple line demand driven full saturation drive). The drive scheme generated by subtask 87 is read by subtasks 88 and 90, which update in RAM memory 16 the simulated image array and the bias violation array respectively, and by subtask 89, which applies the requested voltage levels to the electrodes on the actual LCD 10.

Figure 6:
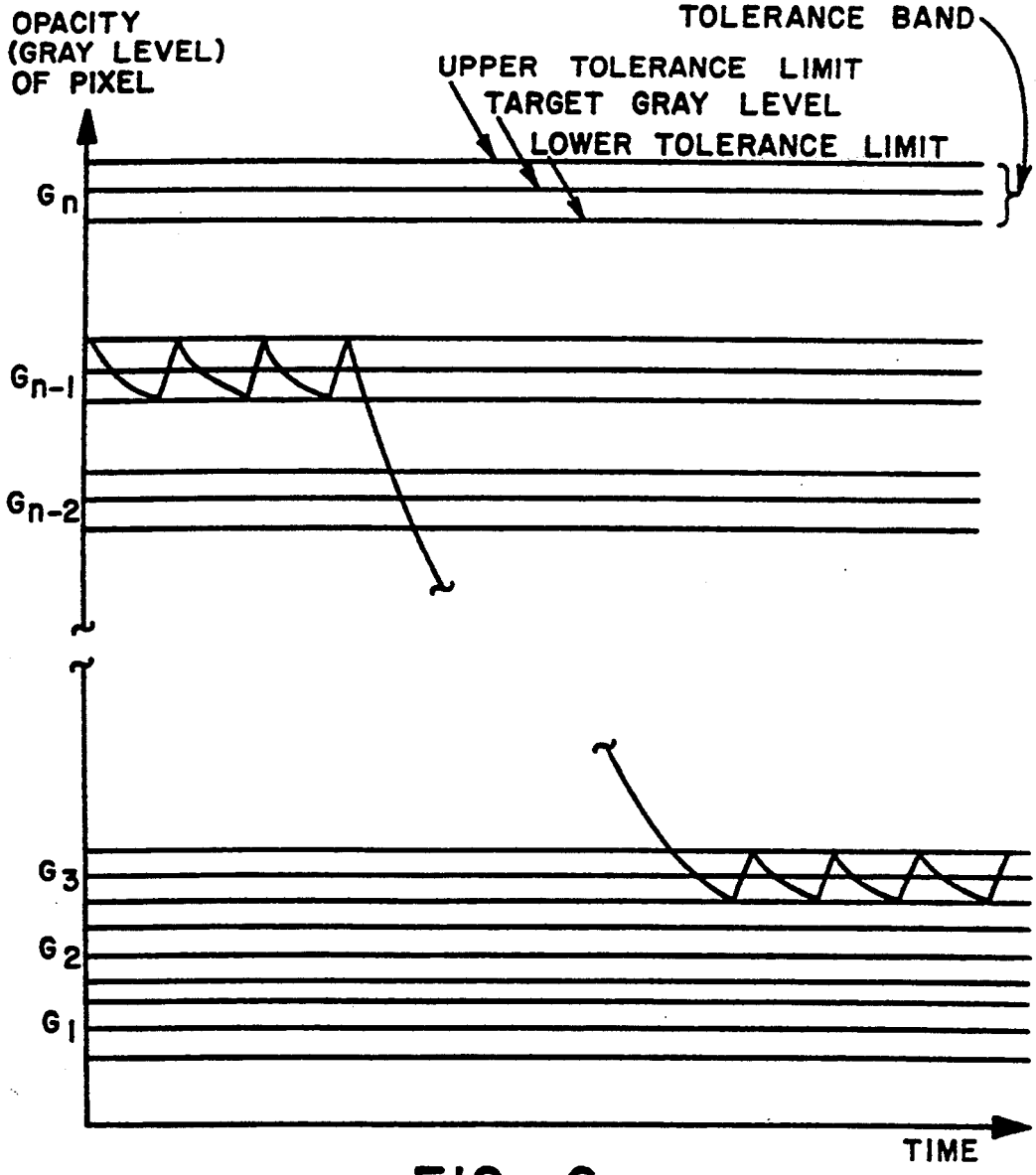
FIG. 6 illustrates the concept of pixel modulation, which is the voltage/gray scale fluctuation of an individual pixel being driven to a desired gray level using the refresh and decay scheme.

Subtask 88, Update real time simulated image array, subtask 89, synthesize voltage at electrode and subtask 90, Update bias violation array in real time. Both employ the data generated by subtask 87, generate drive scheme, status of the pixels, whereas subtask 89 operates directly on the LCD 10. As explained, subtask 87 generates a drive list which is employed by these three subtasks 88, 89 and 90. Subtask 88 employs this list and the data parameters stored in ROM memory 14 to calculate a list of numbers to add to the image array memory, stored in RAM 16. The generated list is offset variables composed of positive, negative and zero numbers that are added to the corresponding memory cells so that a pixel that is driven on is increased in numeric value, a pixel not driven is decreased in value (since it is in a decay mode as illustrated in FIG. 6).

Zero is applied to pixels that are unchanged such as pixels that are off (below threshold voltage) and are not driven, pixels that are maintained at their gray level or ferroelectric pixel that have reached a gray level rest state (Note: Ferroelectric LCDs are multistable devices that have several discrete stable gray levels). Subtask 90 generates the bias violation offset numbers that refers to the DC bias violation.

Subtask 90 calculates the gray level gradation a pixel is driven to and, in turn, generates a numeric value corresponding to the bias violation. These offsets are calculated based on the principle that the darker the pixel the greater the absolute value generated. These offset numbers are added to the corresponding memory cells in the bias violation memory array. When any pixel memory cell approaches MVBT and bias reconciliation is performed, the polarity of the number generated by this task is reversed. For example, when the LCD 10 is powered on the bias violation offset numbers generated for each pixel are zero or a positive number. When a pixel reaches MVBT, for example 127, the drive polarity is reversed and the numbers generated as offset values are then negative or zero. This continues until MVBT is reached in this polarity at 127. The cycle is then repeated.

Application of the requested voltage levels is implemented through pulse width and pulse frequency modulation as previously described by modifying the bit patterns loaded into the shift registers, thereby modulating the voltages applied to the electrodes. By employing this technique, the present embodiment can generate discrete and reproducible voltage levels at all of the electrodes simultaneously. The applied voltage to the electrodes can be varied selectively by use of this technique from 0 VDC to the maximum attainable voltage for the display (e.g. +30 VDC). By applying this range of voltages to the electrodes selectively, the voltage experienced across the pixels can be varied across the full range of maximum and minimum attainable votages (e.g. _30 VDC).

To apply the present embodiment to the full saturation drive schemes described above, the display controller 11 can selectively apply a plurality of voltage levels to a plurality of electrodes to achieve any of the five full saturation drive schemes previously described.

To generate PPM drive schemes in the present embodiment, the following must be achieved:

1. Pixels are driven to and maintained at their specified gray levels.

2. Each pixel remains near the center of its gray tolerance band for the majority of its fluctuation time, rather than at or near the boundaries of the band.

3. A single drive pulse applied to a pixel at or near the center of its gray band should not drive the pixel out of its gray band.

4. A drive pulse must be applied to each pixel before it falls below the lower boundary of its specified gray band.

5. A drive pulse applied to a pixel that is near the lower limit of its gray band will impart enough energy to the pixel to prevent it from falling below the lower tolerance limit of that gray band before the next refresh cycle.

6. The "drive transition time" (the time required for a pixel at the lowest gray level to transition to the highest gray level) is within time tolerances. For animated displays the drive transition time will generally be 1/30second or faster. For more static displays such as computer screens the transition time can be relaxed somewhat.

7. The "decay transition time" (the time required for a pixel to decay from the highest gray level to the lowest gray level) is within time tolerances.

Figure 5A:
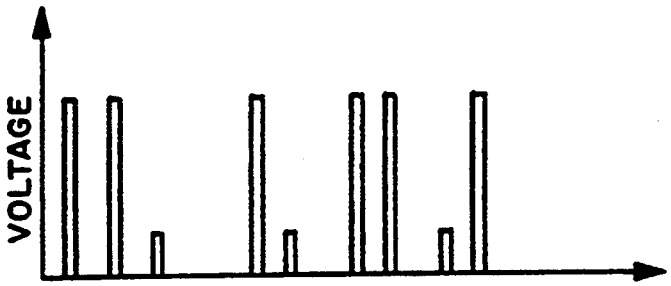
FIGS. 5A, 5B and 5C illustrate the various drive modulation techniques as taught in the present invention. These are selective variations in pulse frequency 5A, pulse width 5B and pulse height, width and frequency of the drive signal pulses 5C as applied at the pixel level.
Figure 5B:
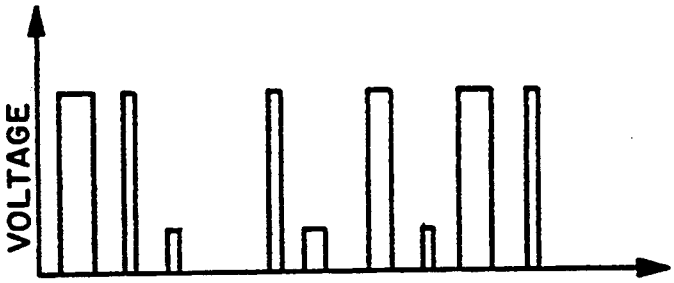
Figure 5C:
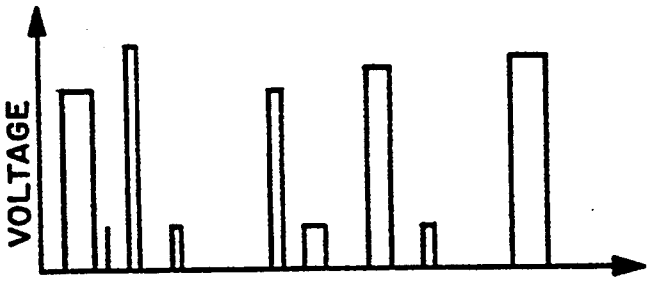

Pixel power modulation is achieved in this embodiment by the application of a plurality of discrete selective drive pulses to the pixels at frequencies, pulse widths and amplitudes sufficient to keep each pixel within its demanded gray tolerance band. The amounts of energy applied to the pixels are varied selectively by modulating the width, frequency, and amplitude of the electrical pulses (pixel power modulation) as illustrated in FIG. 5, and by selectively determining in real time the order and manner in which drive signals are applied to the electrodes (selective real time drive sequencing). Application of an electrical pulse to a pixel causes the energy level of the pixel to rise, thereby increasing the opacity of the pixel (see FIG. 6). During periods in which no pulse is applied to the pixel, the energy level of the pixel decays towards zero, and the opacity decreases until another pulse is applied to the pixel.

The gray tolerance bands are illustrated as non-intersecting regions in FIG. 6, but this is not a requirement of the present invention. FIG. 6 illustrates the gray level varying between different levels by the curve presented therein. The gray tolerance bands can abut or overlap one another. In general, the narrower the gray tolerance bands are, the better is the viewing angle and contrast of the LCD 10. However, broader gray tolerance bands impose lesser demands on the controller 11 than narrower tolerance bands. The present invention also allows intermediate levels of gray to be defined as follows. An intermediate gray level between $Gn_{n-1}$ and $G_n$ (see FIG. 6) would be defined by setting the lower tolerance limit of $G_{n-1}$ as the bottom of a tolerance band, and setting the upper tolerance limit of $G_n$ as the top of a tolerance band. This technique would allow the opacity of the pixel to fluctuate from the bottom of the opacity range of $G_{n-1}$ to the top of the opacity range of $G_n$, rendering a perceived gray level intermediate to the two. This technique can also be applied by overlapping more than two gray bands.

At the point in the drive cycle of the present invention in which the polarity of the drive signals is reversed (when one or more pixels are approaching MBVT), the exception process of bias reconciliation is initiated. This process serves to lower the bias violation status of the pixels and compensates for the optical effect of perceived lower gray levels which occurs during polarity reversal. As the drive controller reverses the polarity of the drive signal, each non-white pixel is driven to a gray level slightly beyond (i.e. darker than) its demanded gray level briefly to compensate for the slight decrease in apparent gray level of those pixels as they cross through the zero voltage condition.

Figure 3B:
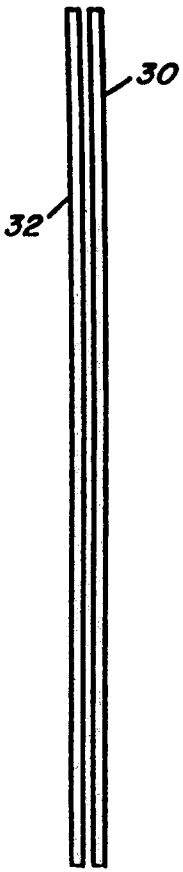
FIGS. 3A and 3B respectively graphically illustrate an active matrix liquid crystal display (AMLCD) and a side view showing the active component layer and backplanes.
Figure 3A:
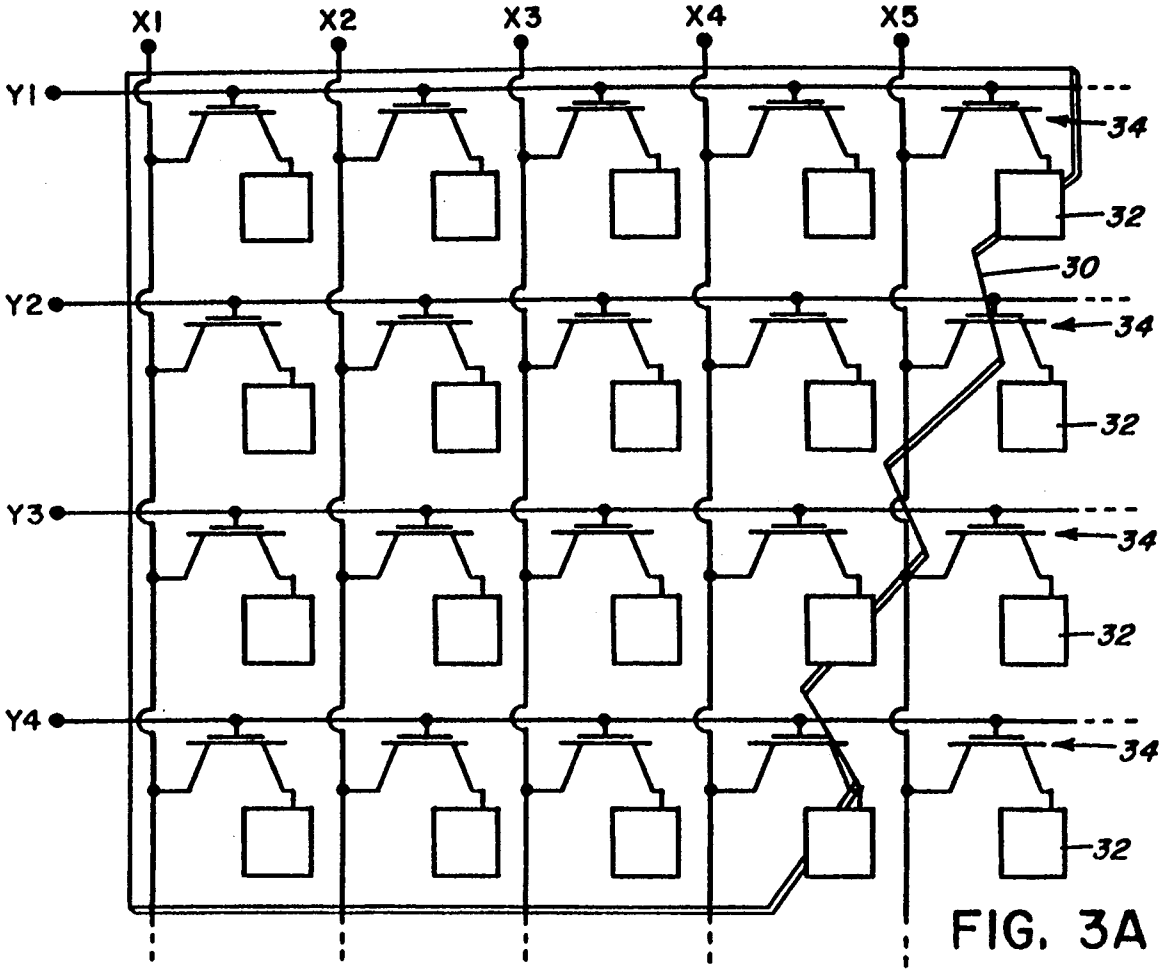

The display control and techniques taught in the present invention is also applicable to active matrix liquid crystal displays (AMLCDs). An AMLCD, as illustrated in FIGS. 3A and 3B, has a backplane 30 and an active plane 32 and is commonly configured as a thin film matrix of MOS field effect transistors (MOSFETs 34), although other nonlinear devices can be employed. As seen in FIG. 3, the active matrix network is addressed by means of the source and gate electrodes that connect to the MOSFETs 34 which are matrix addressed through the row and column electrodes Y and X of the panel substrate (or backplane) 30. Individual MOSFETs 34 are switched on by means of addressing the gate and source via the row and column electrodes Y and X corresponding to the desired MOSFET(s). The MOSFETs 34 are typically applied to the display as a thin film deposited on the glass. The purpose of employing active devices in the display is to achieve increased definition of the threshold turn-on, which renders the cross talk voltages less critical—i.e. the reduction in display contrast resulting from cross talk induced noise is reduced. Pixel addressing in an AMLCD is accomplished by addressing the MOSFETs 34, which indirectly address the pixels via the MOSFET drain electrodes, thereby establishing a field between the drain electrode and the backplane electrode at the opposite substrate of the display. AC driving is achieved in AMLCDs by reversing the polarity of the drive signal applied to the source electrode of the MOSFETs 34 in each frame cycle.

In AMLCDs additional factors must be taken into account for determining the appropriate voltage levels to be applied to the electrodes as compared to passive matrix LCDs. Use of transistors in AMLCDs renders the voltage applied to the pixel (via the drain electrode of the transistor) a function of the voltage at the source, the voltage at the gate, and the beta characteristics of the transistor. Prior art AMLCD controllers apply one line at a time address sequences similar to prior art passive matrix LCD controllers, as is taught in U.S. Pat. No. 4,830,466, Nobuaki, et al. To apply the display drive and control techniques taught in the present invention to AMLCDs, the designer of the display controller must adjust the voltage levels applied to the row and column electrodes to account for these considerations. The necessary adjustments will vary from display to display as a function of electrical characteristics of the transistors (or other active devices) used in the display.

This patent application has presented several embodiments of the principles of this invention, the scope of which is interpreted by the appended claims. Modifications and variations apparent to one of skill in the art are included in the scope of protection afforded by the appended claims.

I claim:

1. In combination, display means formed from a plurality of elements each constructed to provide for the display of an image in accordance with the introduction of signals to such element, the elements being arranged in rows and columns, first means for selecting the elements in a plurality of rows for simultaneous processing, second means for providing signals to obtain the display of the images in the elements in the selected rows, and third means for processing the signals provided for the elements in the selected rows in a priority dependent upon the characteristics of such signals.

2. In a combination as set forth in claim 1, the elements constituting liquid crystal displays.

3. In a combination as set forth in claim 1, fourth means for storing the images previously provided in the elements in the display means, the third means being operative to process the signals provided for the elements in the selected rows in a priority dependent upon the differences between the stored images for the elements in the selected rows and the images represented by the signals provided for the elements in the selected rows.

4. In a combination as set forth in claim 3, fifth means for providing for the display of the images in the elements in the selected rows in accordance with the processing of the signals for such elements by the processing third means.

5. In a combination as set forth in claim 4, the third means being operative to process simultaneously the signals provided for more than one of the elements in the selected rows in the display means in accordance with the characteristics of such signals. time in each such successive sequence.

6. In a combination as set forth in claim 4, means for determining the temperatures of the elements, and means responsive to the determination of the temperatures of the elements for modifying the operation of the fifth means, in accordance with such determinations, in providing for the display of the images in the elements in the selected rows.

7. In combination, display means formed from a plurality of elements each constructed to provide for the display of an image in accordance with the introduction of signals to such elements, first means for providing a plurality of signals each representing the image to be displayed on an individual one of the elements, and second means for applying direct voltages to the elements in accordance with the signals provided for the elements to obtain a display on the display means, the first means being operative to provide the images for the elements in the plurality in a sequence of successive frames, and the second means being operative to apply the direct voltages to the elements in the plurality, in successive ones of the successive frames in the sequence, in accordance with the signals provided for such elements in such successive frames to obtain the display of the images for such elements in such successive frames on the display means.

8. In a combination as set forth in claim 7, the images from the elements being provided in a sequence of successive frames, each of the elements in the plurality having a maximum bias violation tolerance, and third means for reversing the polarity of the direct voltages applied to individual ones of the elements in the plurality in the successive frames when the cumulative magnitudes of the direct voltages applied to such individual ones of the elements in the successive frames approach the maximum bias violation tolerance.

9. In a combination as set forth in claim 7, third means for providing a memory, fourth means for storing in the third means the cumulative direct voltages applied to the individual ones of the elements in the display means in the successive frames, fifth means for providing a maximum bias violation tolerance, and sixth means for comparing the cumulative direct voltages stored in the third means in the successive frames for the individual ones of the elements in the display means and the maximum bias voltage tolerance for such individual ones of the elements to determine whether the direct voltages applied to such individual ones of the elements in the successive frames should be reversed.

10. In combination for use with display means formed from a plurality of elements each constructed to provide for the display of an image in accordance with the introduction of signals to such element, first means for providing signals representing the images to be demanded from individual elements in the display means, second means for storing signals representing the images provided from the .individual elements in the display means, third means for providing, for the individual elements in the display means, signals representing the difference between the signals from the second and first means for such elements, and fourth means for changing the images from the individual elements in the display means in accordance with the signals from the third means for such elements, the fourth means being operative to introduce direct voltages to the individual elements in the display means in accordance with the signals from the third means for such individual elements to change the images from such individual elements, fifth means for reversing the polarity of the direct voltages applied to the individual elements in the display means when the cumulative values of the direct voltages introduced to such individual elements approach a maximum bias voltage tolerance, and sixth means for establishing a priority in the changes provided in the individual elements in the display means in accordance with the characteristics of the signals from the third means for such individual elements, the sixth means being operative to establish the same priority in the changes provided by the fourth means for different ones of the individual elements in response to the same characteristics of the signals from the third means for such different ones of the individual elements.

11. In combination for use with display means formed from a plurality of elements each constructed to provide for the display of an image at such element in accordance with the introduction of signals to such element, first means for providing signals representing the images to be provided from individual elements in the display means, second means for providing for the processing simultaneously of the signals representing the images from a plurality of the individual elements in the display means, and third means for providing for the processing by the second means of the signals representing the images from the different ones of the individual elements in the display means in a priority dependent upon the characteristics of such signals.

12. In a combination as set forth in claim 11, the individual elements in the plurality being disposed in a plurality of successive rows, the second means being operative to provide for the processing simultaneously of the signals for the elements in different ones of the rows in the plurality.

13. In a combination as set forth in claim 11, the third means including fourth means for providing drive voltages with an individual one of amplitude modulations, frequency modulation, and pulse width modulations to produce images from the individual ones of the elements in the display means in accordance with the characteristics of the signals representing the images to be provided from such individual ones of the elements.

14. In a combination as set forth in clam 13, fifth means for determining the temperatures of the elements in the plurality, and sixth means for modifying the operation of the fourth means in accordance with the temperature determinations from the fifth means.

15. In a combination as set forth in claim 11, the first means providing in successive sequences the signals representing the images to be provided from the individual elements in the display means, the third means being operative to process the signals from the elements in the display means in a minimal time in each such successive sequence.

16. In combination for use with display means formed from a plurality of elements each constructed to provide for the display of an image in accordance with the introduction of signals to such elements, first means for providing successive sequences of signals each representing the image to be provided from an individual one of the elements in the display means, each successive sequence of signals representing the image to be provided by all of the elements in the display means, second means for processing the signals in each successive sequence on an asynchronous basis relative to the provisions of the signals in each such successive sequence by the first means, and third means for providing for the display of the images on the elements in the display means in each successive sequence in accordance with the processing of the signals by the second means on the asynchronous basis relative to the provisions of the signals in each such successive sequence by the first means, the second means processing the signals for the individual elements in the display means in each successive sequence on a basis dependent upon the difference in the image from each element in the display means in such successive sequence and the previous one of such successive sequence, the second means processing the signals simultaneously for a plurality of the individual elements in each successive sequence on a priority basis dependent upon the characteristics of the signals representing the images from such individual elements in such successive sequence.

17. In combination for use with display means formed from a plurality of elements each constructed to provide for the display of an image in accordance with the introduction of signals to such element, first means for providing successive sequences of signals each representing the image to be provided from an individual one of the elements in the display means, each successive sequence of signals representing the images to be provided by all of the elements in the display means, second means for processing the signals in each successive sequence to determine the difference between the signals for each individual one of the elements in such successive sequence and the previous sequence, and third means for displaying the image from each individual one of the elements in the display means in each successive sequence in accordance with the difference signal from the second means for that element in that sequence and the previous sequence.

18. In a combination as set forth in claim 17, the third means including fourth means for processing the difference signals from the second means for the different elements in the display means on a priority basis for each sequence and the previous sequence in accordance with the characteristics of such difference signals from such different elements in that sequence and the previous sequence.

19. In a combination as set forth in claim 17, the third means including fourth means for applying a direct voltage to each individual one of the elements in the display means in each successive sequence in accordance with the difference signal from the second means in that element for that sequence and the previous sequence.

20. In a combination as set forth in claim 19, fifth means for determining the temperatures of the elements, and sixth means for modifying the production of the direct voltages by the fourth means for the different elements in the display means in accordance with the temperature determinations by the fifth means.

21. In a combination as set forth in claim 17, the third means including fourth means for processing the difference signals from the second means for the different elements in the display means on a priority basis in each successive sequence and the previous sequence in accordance with the characteristics of such difference signals from the different elements in that successive sequence and the previous sequence, the fourth means applying the direct voltage to each individual one of the elements in the display means in each successive sequence in pulses which progressively reduce the magnitude of the difference signal for such element and the pulses being applied to the different elements in the display means in each sequence on a priority related to the magnitudes of the difference signals for such different elements in the display means in that sequence and the previous sequence.

22. In combination for use with display means formed from a plurality of elements each constructed to provide for the display of an image in accordance with the introduction of signals to such element, the elements being constructed to become charged and discharged to provide a display in accordance with the net charge on such elements, first means for providing successive sequences of signals each representing the image to be provided from an individual one of the elements in the display means, each successive sequence of signals representing the images to be provided by all of the elements in the display means, second means for processing the signals from the different elements in the display means in the successive sequences to determine the changes to be made in the display means from the different elements in the display means in such successive sequences, and third means for providing for changes in the charges in the different elements in the display means in each successive sequence in accordance with the changes determined for such elements by the second means in that successive sequence.

23. In a combination as set forth in claim 22, fourth means for determining the temperatures of the elements, and fifth means for modifying the changes in the charges provided in the different elements by the third means in accordance with the temperature determinations by the fourth means.

24. In a combination as set forth in claim 22, the third means being operative to provide for charging of individual ones of the elements in the display means in each successive sequence, and for discharging of other ones of the elements in the display means in such sequence, in accordance with the polarity and the magnitude of the changes determined for such different elements by the second means in such sequence.

25. In a combination as set forth in claim 24, the elements constituting passive displays, the third means being operative to provide an introduction of signals to the individual ones of the elements in the display means in each successive sequence to drive such individual elements in the display means in such sequence in accordance with a first polarity in the changes determined for such individual ones of such elements by the second means in such sequence and to inhibit the introduction of signals to the other ones of the elements in the display means in such sequence to provide for a decay of such other ones of the elements in the display means in such sequence in accordance with a second polarity in the changes determined for such other ones of such elements by the second means in such sequence.

26. In a combination as set forth in claim 24, the elements constituting active displays, the third means being operative to provide an introduction of a voltage of a first polarity to individual ones of the elements in the display means in each successive sequence to charge such individual ones of the elements in the display means in such sequence in accordance with a first polarity in the changes determined for such individual ones of the elements by the second means in such sequence and to provide an introduction of a voltage of a second polarity to other ones of the elements in the display means in such sequence to discharge such other ones of the elements in the display means in such sequence in accordance with a second polarity in the changes determined for such other ones of such elements by the second means in such sequence.

27. In combination for use with display means formed from a plurality of elements constructed to provide for the display of an image in accordance with the introduction of signals to such elements, the elements being disposed in rows and columns in the display means, first means for providing successive sequences of signals each representing the image to be provided from an individual one of the elements in the display means, each successive sequence of signals representing the image to be provided by all of the elements in such sequence, second means for processing the signals for the different elements in the display means in the successive sequences to determine the relative characteristics of the images in such different elements in such successive sequences, third means for processing the signals from the second means in each successive sequence to determine, from the relative characteristics of the images in the elements in such successive sequence, whether the rows or columns of the elements in the display means should be scanned in such successive sequence, fourth means for scanning the rows or columns in each successive sequence in accordance with the determinations provided by the third means in such successive sequence, and fifth means for changing the images provided from the different elements by the fourth means in each successive scan of the elements in the rows or columns in accordance with the relative characteristics determined by the second means for the different elements in such successive scan of the elements in the rows or columns.

28. In a combination as recited in claim 27,
sixth means for determining the temperatures of the elements, and
seventh means for modifying the operation of the fifth means in accordance with the temperature determinations by the sixth means.

29. In a combination as set forth in claim 27,
the fifth means being operative to apply direct voltages to the different elements in the display means in each successive scan of the rows or columns to change the images from such different elements in such successive scan in accordance with the relative characteristics determined by the second means for such different elements in such successive scan.

30. In a combination as set forth in claim 29,
sixth means for changing the polarity of the direct voltages applied to the different elements in the display means in the successive scans when the accumulation of the direct voltages applied to such different elements in the successive scans approaches a maximum bias violation tolerance.

31. In a combination as set forth in claim 29,
sixth means for providing an indication of the accumulation of the direct voltages applied to the different elements in the display means in the successive scans,
the fifth means being responsive to the indications from the sixth means for the different elements in the display means in the successive scans to change the polarity of the direct voltage applied to such different elements when the seventh means indicates that the direct voltage applied to such elements in the successive scans approaches a maximum bias violation tolerance.

32. In combination for use with display means formed from a plurality of elements each constructed to provide for the display of an image in accordance with the introduction of signals to such element,
first means for providing signals representing the images to be provided from individual ones of the elements in the display means,
second means responsive to the signals from the first means for the individual ones of the elements in the display means and to the images displayed in such individual ones of the elements in the display means for producing signals representing the changes to be provided in such images from such individual ones of the elements, and
third means responsive to the signals from the second means for applying direct voltages to the individual ones of the elements in the display means to obtain the changes in the images in the individual ones of the elements in the display means.

33. In a combination as set forth in claim 32,
fourth means for determining the temperatures of the elements, and
fifth means for modifying the voltages applied by the third means to the individual ones of the elements in the display means in accordance with the temperature determinations by the fourth means.

34. In a combination as set forth in claim 32,
the third means including fourth means for applying the direct voltages to the individual ones of the elements in the display means in the form of incremental pulses to obtain the changes in the individual ones of the elements in the display means.

35. In a combination as set forth in claim 34,
the fourth means providing the incremental pulses to the individual ones of the elements in the display means in a selected one of amplitude modulation, frequency modulation and pulse width modulation.

36. In a combination as set forth in claim 35,
the fourth means applying the direct voltages to the individual ones of the elements in the display means in a priority dependent upon the changes to be provided in the images from such individual ones of the elements in the display means.

37. In a combination as set forth in claim 36,
the third means including fifth means for reversing the polarity of the direct voltages applied to the individual ones of the elements in the display means when the direct voltages in such individual ones of the elements in the display means approach a maximum bias violation tolerance.

38. In combination for use with display means formed from a plurality of elements each constructed to provide for the display of an image in accordance with the introduction of signals to such element,
first means for providing signals representing the images to be provided from individual ones of the elements in the display means,
second means for storing the signals representing the images provided from the individual ones of the elements in the display means,
third means responsive to the signals from the first and second means from the individual ones of the elements in the display means for providing signals representing the differences between the signals from the first and second means for such individual ones of the elements in the display means, and
fourth means responsive to the signals from the third means for providing for increases in the gray levels of the images in first elements in the display means in accordance with differences of one polarity as represented by the signals from the third means for such first elements and for providing for decreases in the gray levels of the images in second elements in the display means in accordance with differences of an opposite polarity as represented by the signals from the third means for such second elements.

39. In a combination as set forth in claim 38,
fifth means for determining the temperatures of the elements, and
sixth means for modifying the operation of the fourth means in accordance with the temperature determinations by the fifth means.

40. In a combination as set forth in claim 38,
the elements being passive elements providing an electrical charge dependent upon the gray levels of the images from such elements and providing for a decrease of such electrical charges with progressions in time and the fourth means providing for increases of the electrical charges in the first elements in accordance with the differences of the first polarity as represented by the signals from the third means for such first elements and for decreases of the charges in the second elements in accordance with the differences of the opposite polarity as represented by the signals from the third means for such second elements.

41. In a combination as set forth in claim 38,
the elements being active elements each including a member providing a flow of current in one direction to increase the gray level of the image in such element and providing a flow of current in an opposite direction to decrease the gray level of the image in such element, the direction and the magnitude of the flow of current in the member in each element being dependent upon the signal from the third means for such element.

42. In a combination as set forth in claim 40, the fourth means being operative to provide direct voltages to the elements to increase the gray levels of the images in the elements, the direct voltages providing selected ones of amplitude modulation, frequency modulation and pulse width modulation.

43. In a combination as set forth in claim 41, the fourth means being operative to provide direct voltages of one polarity to the elements to increase the gray levels of the images in the elements and to provide direct voltages of the opposite polarity to the elements to decrease the gray levels of the images in the elements, the direct voltages providing selected ones of amplitude modulations, frequency modulations and pulse width modulations.

44. In combination for use with display means formed from a plurality of elements each constructed to provide for the display of an image in accordance with the introduction of signals to such element, first means for providing signals representing the gray levels of images to be provided from individual ones of the elements in the display means, second means for storing the signals representing the gray levels of the images provided from the individual ones of the elements in the display means, and third means for providing drive pulses on an incremental basis to the individual ones of the elements in the display means to minimize on the incremental basis the differences between the gray levels of the provided images from the second means and the gray levels of the to-be-provided images from the first means for such individual elements.

45. In a combination as set forth in claim 44, fourth means for applying a priority to the different elements in the display means in accordance with the differences between the gray levels of the provided images from the second means and the gray levels of the to-be-provided images from the first means for such different elements to obtain the introduction of the drive pulses on such incremental basis to such different elements for minimizing on the incremental basis the differences between the gray levels of the images from the second and first means for such different elements.

46. In a combination as set forth in claim 45, fifth means for re-establishing the priority during the application of the drive pulses to the different elements in the display means in accordance with progressive determinations of the differences in the gray levels of the images from the first and second means.

47. In a combination as set forth in claim 44, the third means being operative to apply the pulses to the different elements in the display means in a selected one of amplitude modulation, frequency modulation and amplitude width modulation.

48. In a combination as set forth in claim 44, fourth means for determining the temperatures of the elements in the display means, and fifth means for modifying the drive pulses from the third means to the different elements in the display means in accordance with the temperature determinations by the fourth means, the third means being operative to apply the pulses to the different elements in the display means in a selected one of amplitude modulation, frequency modulation and pulse width modulation, fourth means for determining the temperatures of the elements in the display means, and fifth means for modifying the drive pulses from the third means to the different elements in the display means in accordance with the temperature determinations by the fourth means.

49. A drive system for a matrix addressable electro-optic display formed of a plurality of pixels, wherein the image is produced during successive display periods, said pixels being capable of being driven in either of two opposite polarity directions to produce the desired display, means for driving said pixels in a first polarity for a plurality of successive display periods, said pixels having a maximum bias violation tolerance, said drive system comprising means for reversing the first polarity of said drive signals to said pixels to prevent any of said pixels from exceeding said maximum bias violation tolerance, said pixels being overdriven in a reverse polarity direction for an initial display period to compensate for optical effects of polarity reversal on said display.

50. In a combination as set forth in claim 9, seventh means for reversing the polarity of the direct voltage applied to the individual ones of the elements in the successive frames when the cumulative direct voltages applied to such individual ones of the elements in the successive frames approaches the maximum bias violation tolerance.

51. In a combination as set forth in claim 44, fourth means for applying a priority to the different elements in the display means with the greatest differences between the gray levels of the provided images from the second means for such different elements and the gray levels of the to-be-provided images from the first means for such different elements to obtain the introduction of the drive pulses on such incremental basis to such different elements for minimizing on the incremental basis the differences between the gray levels of the images from the second and first means for such different elements.

52. In a combination as set forth in claim 51, fifth means for re-establishing the priority during the application of the drive pulses to the different elements in the display means in accordance with progressive determinations of the differences in the gray levels of the images from the first and second means.

53. In combination, display means formed from a plurality of elements each constructed to provide for the display of an image in accordance with a charge on such element, first means for providing a plurality of signals representing the images to be provided on the different elements in the display, second means for selecting a number, more than one (1), of the elements on a priority basis for simultaneous processing in accordance with the characteristics of the signals representing the images for such elements, and third means for simultaneously producing voltage changes on the selected elements on an incremental basis in accordance with the characteristics of the signals representing the images for such elements.

54. In a combination as set forth in claim 53, fourth means for selecting a number, more than one (1), of the elements at successive time periods for simultaneous processing on a priority basis in accordance with the differences between the characteristics of the signals for such elements and the voltage changes produced on the incremental basis for such elements at such successive time periods in accordance with the characteristics of such signals.

55. In a combination as set forth in claim 54, the third means being operative to provide direct voltages for simultaneously producing the voltage changes on the selected elements on the incremental basis in accordance with the characteristics of the signals representing the images for such elements.

56. In a combination as set forth in claim 55, fifth means for reversing the polarity of the direct voltages applied to the different elements on the incremental basis when the voltages applied to such different elements approach a maximum bias violation tolerance.

57. In combination, display means formed from a plurality of elements each constructed to provide for the display of an image in accordance with the introduction of signals to such element, the elements being disposed in a relationship defined by a plurality of rows and a plurality of columns, first means for providing the signals for each of the elements in each of a plurality of successive scans, second means for analyzing the signals for the elements in each scan to determine the priorities to be established in the rows or columns in such scan for acting upon the elements in such scan in producing the images for such elements, and third means for acting upon the elements in the rows and columns in each scan in accordance with the priorities determined for such rows or columns by the second means in such scan to produce the images on the elements in such scan.

58. In a combination as set forth in claim 57, the second means including means for analyzing the signals from the elements in each scan to determine whether the priorities should be established for the rows or the columns, and the third means including means for acting upon the elements in the rows or columns in accordance with determinations by the second means as to whether the priorities should be established in the rows or the columns.

59. In a combination as set forth in claim 57, the third means including means for introducing progressive voltage increments to the elements in each scan in accordance with the priorities established by the second means in such elements in such scan.

60. In a combination as set forth in claim 58, the second means including means operative after the introduction of the voltage increments to the elements in each scan for analyzing the differences between the signals for such elements in such scan and the images on such elements in such scan to redetermine the priorities to be established in the rows and columns in such scan for acting upon the elements in such scan in producing the images for such elements, and the third means including means for acting upon the elements in such scan in accordance with the priorities redetermined for such rows and columns by the second means in such scan to produce the images on the elements in such scan.

61. In combination, display means formed from a plurality of elements each constructed to provide for the display of an image in accordance with the introduction of signals to such element, the elements being disposed in a relationship defined by a plurality of rows and a plurality of columns, first means for providing the signals for each of the elements in each of a plurality of successive scans, second means for analyzing the signals for the elements in each scan to determine the priorities to be established initially in the rows or columns in such scan for acting upon the elements in such scan in producing the images for such elements, third means for applying voltage increments to the elements in such scan in accordance with the priorities initially established by the second means for the elements in such rows or columns in such scan, fourth means responsive to the voltage increments initially applied by the third means to the elements in such scan for obtaining a re-analysis by the second means of the priorities to be established subsequently in the rows or columns in such scan for acting upon the elements in such scan in producing the images for such elements, and fifth means responsive to the re-analysis by the second means for obtaining an operation of the third means in applying incremental changes in voltage to the elements in such scan in accordance with the priorities subsequently established by the second means for the elements in such rows or columns in such scan.

62. In a combination as set forth in claim 61, the second means being operative in the re-analysis to determine whether the priorities should be established for the rows or columns independently of the analysis initially provided by the second means to determine whether the priorities should be established for the rows or columns.

63. In a combination as set forth in claim 61, the third means being operative to apply incremental changes of a direct voltage to the elements in such scan in accordance with the priorities initially and subsequently established for the elements in such rows or columns in such scan.

64. In a combination as set forth in claim 62, the third means being operative to apply incremental changes of a direct voltage to the elements in such scan in accordance with the priorities initially and subsequently established for the elements in such rows or columns in such scan, and sixth means for reversing the polarity of the incremental changes of the direct voltage applied to the elements in such scan when the cumulative value of the direct voltage incrementally applied to such elements approaches a maximum bias violation tolerance.

65. In a combination as set forth in claim 61, the second means being operative initially to establish a priority in the rows over the columns in such raster scan and being subsequently operative to establish a priority in the columns over the rows in such raster scan.

* * * * *

Disclaimer

5,444,457—Robert Hotto, La Jolla CA (US). DC INTEGRATING DISPLAY DRIVER EMPLOYING PIXEL STATUS MEMORIES. Patent dated Aug. 22, 1995. Disclaimer filed April 6, 2011, by the assignee, Positive Technologies, Inc.

The term of this patent shall not extend beyond the expiration date of patent no. 5,444,457.

(*Official Gazette January 10, 2012*)

Disclaimer 5,444,457—Robert Hotto, La Jolla, CA (US). DC INTEGRATING DISPLAY DRIVER EMPLOYING PIXEL STATUS MEMORIES. Patent dated August 22, 1995. Disclaimer filed April 7, 2011, by the assignee, Positive Technologies, Inc.

The term of this patent shall not extend beyond the expiration date of Patent No. 5,280,280.

(*Official Gazette, February 14, 2012*)